US006907806B1

(12) United States Patent
Okamoto et al.

(10) Patent No.: US 6,907,806 B1
(45) Date of Patent: Jun. 21, 2005

(54) SHEET PROCESSING APPARATUS, CONTROL METHOD THEREFOR, SHEET PROCESSING METHOD, AND STORAGE MEDIA

(75) Inventors: Kiyoshi Okamoto, Ohta-ku (JP); Mitsushige Murata, Ohta-ku (JP); Norifumi Miyake, Ohta-ku (JP)

(73) Assignee: Canon Kabushiki Kaisha, (JP)

( * ) Notice: Subject to any disclaimer, the term of this patent is extended or adjusted under 35 U.S.C. 154(b) by 89 days.

(21) Appl. No.: 09/624,619

(22) Filed: Jul. 24, 2000

(30) Foreign Application Priority Data

Jul. 23, 1999 (JP) ..... 11-209160

(51) Int. Cl.[7] ..... B26D 5/28

(52) U.S. Cl. ..... 83/76.8; 83/80; 83/210; 83/211; 83/365; 83/368; 83/370

(58) Field of Search ..... 83/76.8, 79, 80, 83/370, 371, 365, 368, 372, 209, 210, 211, 83/212, 212.1, 213

(56) References Cited

U.S. PATENT DOCUMENTS

| | | | | |
|---|---|---|---|---|
| 5,041,070 | A * | 8/1991 | Blaser | |
| 6,014,920 | A * | 1/2000 | Yamauchi et al. | 83/371 X |
| 6,065,379 | A * | 5/2000 | Shinno et al. | 83/368 X |
| 6,065,383 | A * | 5/2000 | Takaishi et al. | 83/368 |
| 6,209,435 | B1 * | 4/2001 | Miyazaki et al. | 83/368 X |

* cited by examiner

*Primary Examiner*—Charles Goodman
(74) *Attorney, Agent, or Firm*—Rossi, Kimms & McDowel

(57) ABSTRACT

To maintain high productivity and performing high-grade processes while minimizing deviation of a sheet process position in a direction at a right angle to a sheet conveying direction whatever types of sheets are to be processed, timing for starting detection of an end position of each of the sheets is controlled so as to execute the detection of the end position of each of the sheets at a vicinity of a sheet processing position on the sheet at which a sheet process is executed.

21 Claims, 15 Drawing Sheets

PUNCH HP

PUNCHING CARRIED OUT

PUNCHING COMPLETED

FIG.15

| |
|---|
| DIRECTORY INFORMATION |
| PUNCH OPERATION PROCESS PROGRAM MODULES IN FIGS.7,8, AND 9 |
| SHEET END DETECTING PROCESS PROGRAM MODULES IN FIG.10 |
| PUNCH OPERATION PROCESS PROGRAM MODULES IN FIGS.12,13, AND 14 |
| ⋮ |

SHEET PROCESSING APPARATUS, CONTROL METHOD THEREFOR, SHEET PROCESSING METHOD, AND STORAGE MEDIA

BACKGROUND OF THE INVENTION

1. Field of the Invention

The present invention relates to a sheet processing apparatus for performing sheet processes such as a punching process to a sheet, a control method for the sheet processing apparatus, a sheet processing method, and storage media storing programs for executing the methods.

2. Description of the Related Art

Sheet processing apparatuses are known, which perform sheet processes such as sorting, binding, loading, and punching on sheets discharged from an image forming apparatus and each having an image formed thereon.

An example of a sheet process using a sheet processing apparatus such as one described above is a punching process for punching to sheets. For example, a punching method has been proposed, which stacks sheets on a processing tray and punches a bundle of stacked sheets. This method, however, has disadvantages: For example, the bundle of sheets may be too thick to be punched depending on the number of sheets in the bundle to be processed, and taking such a problem into consideration, a large-scale punching unit must be provided. Further, during the punching process, it is impossible to convey a new sheet, or depending on the capacity of the punching unit, the punching process has to be carried out in a plurality of steps, which necessitates suspension of conveyance of sheets from the image forming apparatus. Consequently, the processing speed cannot be increased easily.

To solve the above described problems, a method has been proposed, which provides a punching unit on a sheet conveyance path and conveys a sheet therealong while sequentially punching to the sheet.

This method, for example, provides on a sheet conveyance path a punching unit comprised of punches and dies, and synchronizes the sheet conveyance speed with the punch speed to execute the punching process without stopping the sheets from being conveyed. This method has the advantage that the sheet processing time does not increase even when the punching process is executed.

When sheets are punched while being conveyed as described above, the punching position should desirably be adjusted before actually punching the sheet, so as to punch the sheet being conveyed at an appropriate position thereof. More specifically, it is desirable to carry out both adjustment of the punching position in the sheet conveying direction and adjustment of the punching position in a sheet width direction at a right angle to the sheet conveying direction, followed by carrying out punching of the sheet. The adjustment of the punching position in the sheet conveying direction is carried out by, for example, detecting appearance of a leading end (in the sheet conveying direction) of the sheet being conveyed and controlling timing for execution of the punching process based on a result of the detection to thereby adjust the punching position in the sheet conveying direction. On the other hand, the punching position in the sheet width direction at a right angle to the sheet conveying direction is adjusted by, for example, detecting an end position of the sheet being conveyed in the sheet width direction and moving and adjusting the punching unit in the sheet width direction based on a result of the detection to thereby adjust the punching position in the sheet width direction. Both adjustments are carried out based on the sheet to be punched while the sheet is being conveyed, as in an actual punching process.

The apparatus of this type can convey different types (for example, different sizes) of sheets and can execute the above described punching process on various sheets. However, the same manner of adjustment of the punching position in the sheet width direction at a right angle to the sheet conveying direction is applied whatever types of sheets are to be punched.

According to the above described method, however, both the adjustments of the punching position and the punching process depending on these adjustments are carried out while sheets are conveyed. Consequently, if, for example, a sheet to be punched skews while being conveyed, the amount of skewing of the sheet at the time of actual punching is larger than that at the time of execution of the adjustment of the punching position in the sheet width direction. That is, an appropriate position to be punched may change gradually during the sheet conveyance, whereby the punching position in the sheet width direction at a right angle to the sheet conveying direction is shifted. In spite of the possibility of such a phenomenon, the same manner of adjustment of the punching position in the sheet width direction is applied for any types of sheets. This leads to, for example, while a disadvantage that sheets of a certain size do not substantially deviate in punching position, sheets of another size significantly deviate in punching position so that the punched sheets are useless, resulting in a waste of resources.

SUMMARY OF THE INVENTION

It is an object of the present invention to provide a sheet processing apparatus, a control method therefor, and a sheet processing method, which are free of the above described problems, and storage media storing programs for executing the control method and the sheet processing method.

It is another object of the present invention to provide a sheet processing apparatus, a control method therefor, a sheet processing method, which are capable of maintaining high productivity and performing high-grade processes while minimizing deviation of a sheet processing position in a direction at a right angle to a sheet conveying direction whatever types of sheets are to be processed, and storage media storing programs for executing the control method and the sheet processing method.

To attain the above objects, according to a first aspect of the present invention, there is provided a sheet processing apparatus for performing a sheet punching process on sheets being conveyed, comprising punching means for punching the sheets, sheet end detecting means disposed for movement together with the punching means, for detecting an end position of each of the sheets being conveyed in a width direction thereof, moving means for moving the punching means and the sheet end detecting means in a direction at a right angle relative to a conveying direction of the sheets, sheet detecting means for detecting each of the sheets being conveyed, movement amount detecting means for detecting an amount of movement by which each of the sheets has moved after detection of the sheet, and movement starting means for determining based on the detected amount of movement whether each of the sheets has reached a predetermined position, and for causing the moving means to start moving the punching means and the sheet end detecting means when each of the sheets is determined to have reached the predetermined position.

Preferably, the movement starting means comprises means for determining whether a distance in the conveying direction of the sheets between the sheet end detecting means and a trailing end of each of the sheets in the conveying direction of the sheets has become equal to a predetermined value, and the movement starting means causes the moving means to start moving the punching means and the sheet end detecting means when the distance has become equal to the predetermined value.

More preferably, the predetermined value of the distance corresponds to a minimum size of the sheets that enables the sheets to be punched.

Preferably, the movement starting means comprises means for determining whether a punching position on each of the sheets has reached a predetermined position, and the movement starting means causes the moving means to start moving the punching means and the sheet end detecting means when the punching position on the sheet has reached the predetermined position.

Preferably, the movement amount detecting means starts detecting the amount of movement of each of the sheets when the sheet detecting means detects the trailing end of each of the sheets.

Alternatively, the movement amount detecting means starts detecting the amount of movement of each of the sheets when the sheet detecting means detects a leading end of each of the sheets in the conveying direction of the sheets.

Preferably, the movement amount detecting means detects the amount of movement of each of the sheets based on a period of time for which the sheet has moved after detection of the sheet by the sheet detecting means and on a speed at which the sheets are conveyed.

In a preferred form of the first aspect, the sheet processing apparatus comprises a conveyance motor for conveying the sheets, and wherein the movement amount detecting means counts a clock for driving the conveyance motor after detection of each of the sheets by the sheet detecting means and detects the amount of movement of the sheet based on a period of time of movement of the sheet corresponding to a count value obtained by the counting.

To attain the above objects, according to a second aspect of the present invention, there is provided a sheet processing method of punching sheets being conveyed using punching means, comprising the steps of detecting each of the sheets being conveyed, detecting an amount of movement by which each of the sheets has moved after detection of the sheet, starting moving the punching means being movable in a direction at a right angle relative to a conveying direction of the sheets when it is determined based on the detected amount of movement that each of the sheets has reached a predetermined position, and moving sheet end detecting means together with the punching means to detect an end position of each of the sheets being conveyed in a width direction thereof.

To attain the above objects, according to a third aspect of the present invention, there is provided a computer-readable storage medium that stores a program for causing a sheet processing apparatus having punching means for punching sheets being conveyed to execute a method comprising a step of detecting each of the sheets being conveyed, a step of detecting an amount of movement by which each of the sheets has moved after detection of the sheet, a step of starting moving the punching means being movable in a direction at a right angle relative to a conveying direction of the sheets when it is determined based on the detected amount of movement that each of the sheets has reached a predetermined position, and a step of moving sheet end detecting means together with the punching means to detect an end position of each of the sheets sheet being conveyed in a width direction thereof.

To attain the above objects, according to a fourth aspect of the present invention, there is provided a sheet processing apparatus comprising sheet processing means for executing a sheet process to a sheet, conveying means for conveying the sheet to be processed by the sheet processing means, detecting means for detecting an end position of the sheet in a direction at a right angle relative to a conveying direction of the sheet, and control means for controlling the sheet processing means to execute the sheet process to a position based on a detection result of the detecting means on the sheet, after a detecting operation by the detecting means, and wherein the control means controls timing for starting the detecting operation by the detecting means so as to execute the detecting operation at a vicinity of a sheet processing position on the sheet at which the sheet process is executed by the sheet processing means.

Preferably, the control means determines the timing for starting the detection of the end position of the sheet by the detecting means, based on a length of the sheet in the conveying direction of the sheet.

Also preferably, the sheet processing means is capable of executing the sheet process on plural types of sheets of different lengths in the conveying direction of the sheets, and wherein the control means sets timing for starting detection of an end position of each of the plural types of sheets in the direction at a right angle relative to the conveying direction of the sheets by the detecting means depending on a length of each of the plural types of sheets in the conveying direction of the sheets.

For example, if the sheet process is carried out on a sheet of a first size or a sheet of a second size having a larger length in the conveying direction of the sheets than the sheet of the first size, the control means delays the timing for starting the detection of the end position of the sheet of the second size with respect to the timing for starting the detection of the end position of the sheet of the first size.

More preferably, the control means sets the timing for starting the detection of the end position of each of the plural types of sheets by the detecting means to different values of timing according to the different lengths of the plural types of sheets in the conveying direction of the sheets such that the detection of the end position of each of the sheets is always carried out at the location close to the sheet processing position.

Preferably, the sheet processing means is movable in the direction at a right angle relative to the conveying direction of the sheet.

More preferably, the detecting means is movable in the direction at a right angle relative to the conveying direction of the sheet.

Preferably, the control means is responsive to starting of the detection of the end position of the sheet by the detecting means, for moving the sheet processing means together with the detecting means.

Preferably, the control means causes the sheet processing means to execute the sheet process without stopping the conveyance of the sheet by the conveying means.

In a typical example of the fourth aspect, the sheet processing means includes punching process means for executing a punching process on the sheet.

Preferably, the sheet processing means executes the sheet process on the sheet without executing a sheet aligning process on the sheet.

As a typical application of the fourth aspect, the sheet processing apparatus can be connected to an image forming apparatus for forming images on a sheet, and wherein the sheet processing means executes the sheet process on a sheet supplied from the image forming apparatus.

Preferably, the control means controls timing for starting the sheet process to be executed on the sheet by the sheet processing means together with the timing for starting the detection of the end position of the sheet by the detecting means, such that the sheet processing means executes the sheet process on the sheet having an image formed surface thereof facing downward, at a trailing end thereof.

To attain the above objects, according to a fifth aspect of the present invention, there is provided a method of controlling a sheet processing apparatus having sheet processing means for executing a sheet process to a sheet, conveying means for conveying the sheet to be processed by the sheet processing means, and detecting means for detecting an end position of the sheet in a direction at a right angle relative to a conveying direction of the sheet, the method comprising a control step of controlling the sheet processing means to execute the sheet process to a position based on a detection result of the detecting means on the sheet, after a detecting operation by the detecting means, and wherein the control step controls timing for starting the detecting operation by the detecting means so as to execute the detecting operation at a vicinity of a sheet processing position on the sheet at which the sheet process is executed by the sheet processing means.

To attain the above objects, according to a sixth aspect of the present invention, there is provided a computer-readable storage medium that stores a program for causing a sheet processing apparatus having sheet processing means for executing a sheet process to a sheet, conveying means for conveying the sheet to be processed by the sheet processing means, and detecting means for detecting an end position of the sheet in a direction at a right angle relative to a conveying direction of the sheet, to execute a method comprising a control step of controlling the sheet processing means to execute the sheet process to a position based on a detection result of the detecting means on the sheet, after a detecting operation by the detecting means, and wherein the control step controls timing for starting the detecting operation by the detecting means so as to execute the detecting operation at a vicinity of a sheet processing position on the sheet at which the sheet process is executed by the sheet processing means.

The above and other objects, features, and advantages of the present invention will be apparent from the following description taken in conjunction with the accompanying drawings.

BRIEF DESCRIPTION OF THE DRAWINGS

FIG. 15 is a diagram showing a memory map for a ROM in a memory 2001 as a storage medium.

DESCRIPTION OF THE PREFERRED EMBODIMENTS

A sheet processing apparatus, a control method, a sheet processing method and storage media storing programs for executing the methods according to the present invention will be described below with reference to drawings showing preferred embodiments thereof. The sheet processing apparatus according to the present embodiments is applicable to image forming systems.

[First Embodiment]

Figure 1:
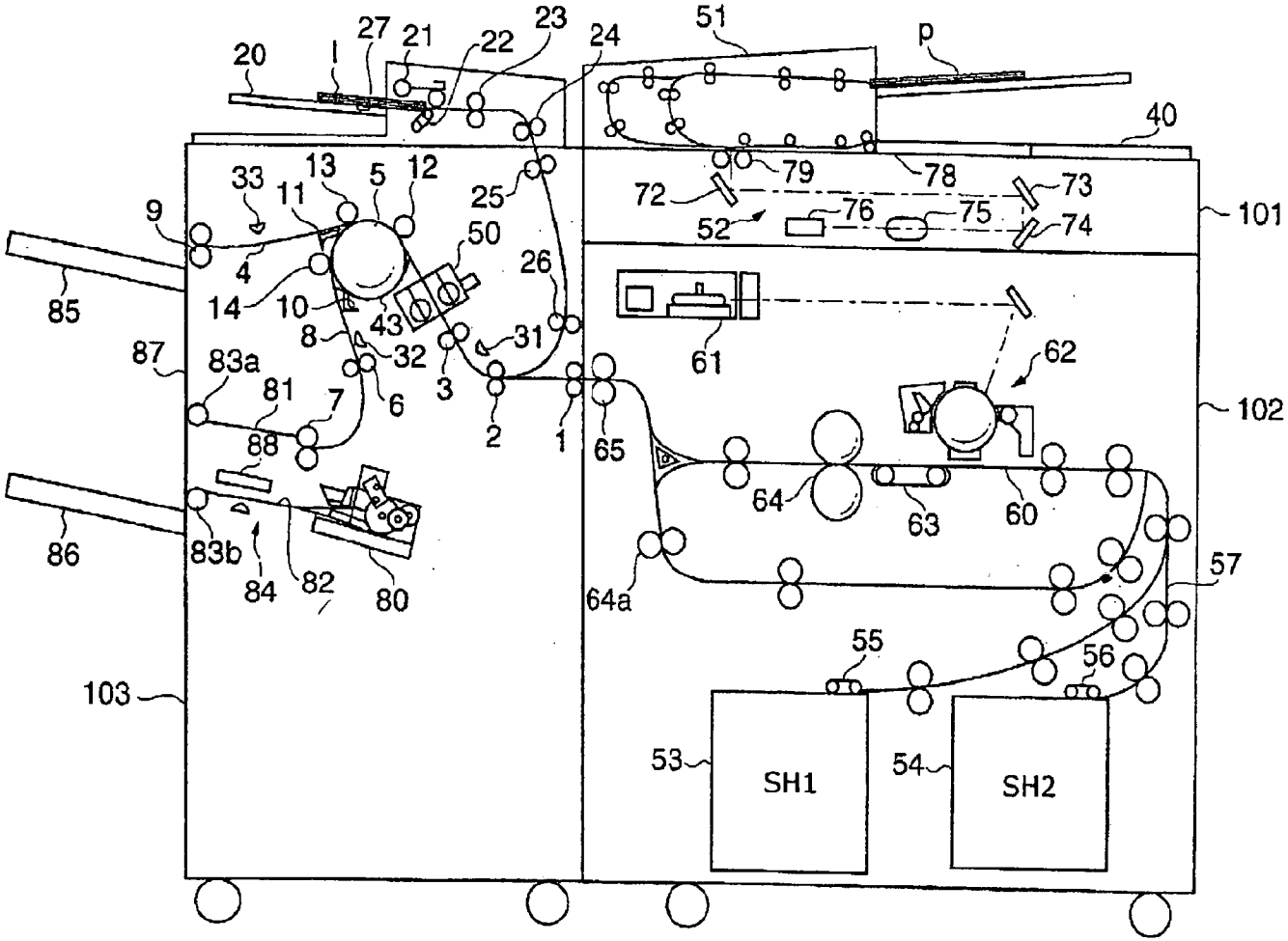
FIG. 1 is a sectional view showing the entire construction of an image forming system to which a sheet processing apparatus according to a first embodiment of the present invention is applied.

FIG. 1 is a sectional view showing the entire construction of an image forming system to which a sheet processing apparatus according to a first embodiment of the present invention is applied. The image forming system is comprised of a reading and sheet feeding apparatus 101, an image forming apparatus 102, a sheet processing apparatus 103, and others.

The reading and sheet feeding apparatus 101 is comprised of an automatic original feeding section 51 for sequentially conveying a bundle of originals p that are set on the section 51 to a reading position on an original table glass 78 starting with a top page (that is, an original in the uppermost layer of the bundle of originals p) and then conveying them to a discharging position, and an optical system having a lamp 79 for applying light to the originals p conveyed to the reading position, a CCD line sensor (hereinafter referred to as "the CCD") 76 for detecting images on the originals, reflecting mirrors 72, 73, and 74 for guiding light from the originals p to the CCD 76, and a lens 75 for forming the images from the originals on the CCD 76.

The image forming apparatus 102 has a plurality of recording sheet storage sections 53 and 54 that have sheets S(SH1, SH2) of different sizes loaded therein, and recording sheet feeding sections 55 and 56 for feeding recording sheets. A fed sheet S is conveyed to a sheet conveyance path 60 via a sheet conveyance path 57. Reference numeral 61 designates a laser scanner for scanning laser light based on image information read, by the optical system 52, to form a latent image (toner image) on a photosensitive body of an image forming section 62.

The image forming section 62 transfers the toner image formed on the photosensitive body to the sheet S. The sheet S, having an image formed thereon by the image forming section 62, is conveyed to a conveyance path of the sheet processing apparatus 103 by means of a conveyance belt 63, a fixing roller 64 which softens and melts the toner image on the recording sheet for fixation, and a conveyance roller 65. For double-sided printing, the image forming section 62 first forms an image on a first side of the sheet, which is then guided toward a roller 64*a* via the roller 64 and conveyed back to the image forming section 62. The image forming section 62 then forms an image on a second side of the sheet, which is then conveyed to the sheet processing apparatus 103 via the rollers 64 and 65 with the second side facing upward. On the other hand, for single-sided printing, the sheet, having an image formed thereon by the image forming section 62, is guided toward the roller 64*a*, which then switches back and guides the sheet toward the roller 65. Then, the sheet with its image formed surface facing downward due to the above conveyance control is conveyed to the sheet processing apparatus 103 via the roller 65 (face down discharging mode). The sheet processing apparatus 103 conveys the sheet while keeping the image formed surface facing downward and stacks the sheet on a predetermined loading unit (for example, a tray 82, a tray 85, or a tray 86) with the image formed surface facing downward. This enables the top page to be processed to improve productivity.

Reference numeral 40 designates an operation section for allowing a user to check operational settings and contents thereof for the image forming apparatus 102 and the sheet processing apparatus 103. The operation section 40 is comprised of a display for allowing the user to check the settings, touch panel keys arranged on the display, for allowing the user to make detailed settings for an image forming operation (for example, setting of the size of sheets on which images are to be formed and setting of a scale factor) and operational settings for the sheet processing apparatus (for example, setting of a sheet processing mode for a punching process, a stapling process, or the like), ten keys for setting numerical values for the number of image forming copies, a stop key for stopping the image forming operation, a reset key for returning the settings to initial ones, a start key for starting the image forming operation, and others.

In the sheet processing apparatus (hereinafter referred to as "the finisher") 103, reference numeral 1 designates an inlet roller of the finisher 103 for conveying the sheet S conveyed from the image forming apparatus 102. Reference numerals 2 and 3 designate conveyance rollers for conveying an insert sheet I with an image previously formed thereon. Reference numeral 31 designates a sheet detecting sensor for detecting, on the inlet side, passage of the sheet S or insert sheet I. Reference numeral 50 designates a punching unit for punching a rear or trailing end portion of the sheet S or insert sheet I, which has been conveyed to the punching unit with its image formed surface facing downward. The punching unit 50 will be described later in detail. By thus punching the rear end portion of the sheet with its image formed surface facing downward, the user can obtain an output result in which a punching position is formed on a left side of the sheet as viewed from the image formed surface.

Reference numeral 5 designates a roller of a relatively large diameter (hereinafter referred to as "the buffer roller") located in the middle of the conveyance path to convey the sheet while pressing it against its roll surface by means of urging rollers 12, 13 and 14 disposed along an outer periphery thereof.

Reference numeral 11 designates a first switching flapper for selectively switching between a non-sort path 4 and a sort path 8. Reference numeral 10 designates a second switching flapper for selectively switching between a buffer path 43 for temporarily storing the sheet S or the insert sheet I and the sort path 8. Reference numeral 33 designates a sheet detecting sensor for detecting the sheet in the non-sort path 4, and reference numeral 32 designates a sheet detecting sensor for detecting the sheet in the sort path 8. Reference numeral 6 designates a conveyance roller provided on the sort path 8.

Reference numeral 84 designates a processing tray unit including an intermediate tray 82 (hereinafter referred to as "the processing tray") for temporarily accumulating sheets, aligning the accumulated sheets S or insert sheet J, and stapling them using a staple unit, and an aligning plate 88 for aligning the sheets S or insert sheet I loaded on the processing tray. The processing tray 82 stacks the sheets S and insert sheet conveyed thereto with their image formed surfaces facing downward in such a manner that their image formed surfaces remain facing downward. The aligning plate 88 aligns the sheets stacked on the processing tray 82 with their image formed surfaces facing downward so as to correct deviation of the sheets in a direction at a right angle to a sheet conveying direction (a perpendicular direction, that is, a sheet width direction), and correct skewing thereof. The staple unit 80 staples rear end portions of the sheets accumulated and aligned with their image formed surfaces facing downward. Consequently, the sheets with images formed thereon can be sequentially discharged in a fashion facing downward, starting with the top page, so that for example, in an image forming apparatus having a copying function and a facsimile or printer function, processing can be started with the top page whatever function is used. Further, the staple unit 80 can be provided in the main body of the image forming apparatus 102. As a result, the user can obtain output results in which the correct page order and image orientation are obtained with a binding position formed on the left side of the sheet as viewed from the image formed surface and without the need to increase the size of the sheet processing apparatus 103 and complicate the construction of the same. Therefore, the apparatus can be operated more easily and has improved productivity, cost performance, and the like. In this connection, the punching process is also controlled such that the sheet is punched at a rear or trailing end portion thereof.

The processing tray 82 has a discharging roller 83*b* as a stationary roller located at a discharging end side thereof and which is one of bundle discharging rollers. Reference numeral 7 designates a first discharging roller arranged in the sort path 8, for discharging the sheets S or insert sheet I onto the processing tray 82. Reference numeral 9 designates a second discharging roller arranged in the non-sort path 4, for discharging the sheets S or insert sheet I onto a sample tray (first loading tray) 85.

Reference numeral 83*a* designates an upper discharging roller supported by a rocking guide 81 and which comes into abutment with the lower discharging roller 83*b* in a pressing fashion when the rocking guide 81 is in a closed position, to discharge the sheets S or insert sheet I in a bundle onto a stack tray (second loading tray) 86 (the sheet bundle discharging operation is performed whenever processing of one group such as a set of sheets forming a copy of a book, for example, is completed). Reference numeral 87 designates a bundle loading guide which comes into abutment with a rear edge (in the bundle discharging direction) of the bundle of sheets loaded on the sample tray 85 to support them and which also acts as a part of a casing of the sheet processing apparatus 103.

Reference numeral 20 designates an insert sheet storage section for setting therein insert sheets I with images previously formed thereon and which are to be inserted into sheets fed from the image forming apparatus main body. Reference numeral 21 designates a feed roller for feeding insert sheets, and reference numeral 22 designates a separating roller for separating the fed insert sheet(s) from the other insert sheets (in the present embodiment, sequentially separating and feeding the insert sheets starting with a top layer sheet). Reference numeral 27 designates an insert sheet set detecting sensor for detecting whether an insert sheet or insert sheets are set in the insert sheet storage section 20. The fed insert sheet I is conveyed to the conveyance roller 2 by means of conveyance rollers 23, 24, 25, 26.

An operator sets the insert sheet I on the storage section 20 in such a manner that the image formed surface of the sheet faces upward (a face-up state) and that a top layer sheet corresponds to a top page while a bottom layer sheet corresponds to a last page in the case of a plurality of pages. In addition, the fed insert sheet I is turned upside down via the conveyance path on the conveyance rollers 23, 24, 25, 26, so that its image formed surface faces downward before it passes through the transfer roller 2.

With such an image forming system, when the user sets originals on the automatic original feeding section 51 of the reading and feeding apparatus 101, makes desired settings via the operation section 40, and then designates start of operation, an image forming operation is started. Once the image forming operation has been started, the reading and sheet feeding apparatus 101 sequentially reads the originals starting with the top page, while the image forming apparatus 102 starts feeding recording sheets from the set recording sheet storage sections 53, 54 to convey them to the image forming section 62 via the sheet conveyance path. A toner image formed based on the image information read by the reading and feeding apparatus 101 is transferred to the fed sheet, which is then passed through the fixing section so that the image is fixed to the sheet. The sheet is then turned upside down so as to have its image formed surface face downward and is then conveyed to the sheet processing apparatus 103. The sheet processing apparatus 103 carries out processing such as conveyance of the insert sheet, punching, classification of the sheets, and stapling before outputting the sheets.

Figure 2:
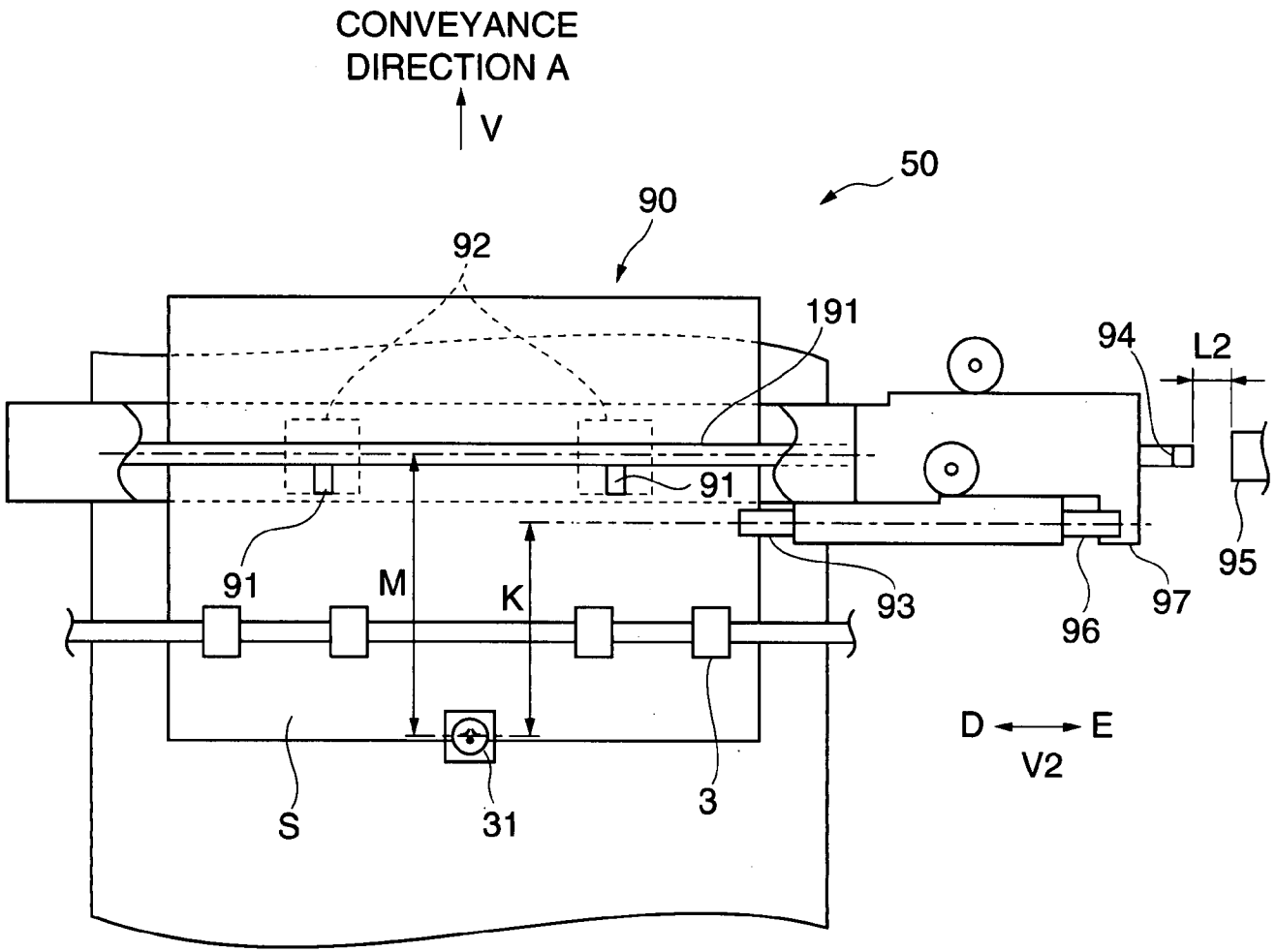
FIG. 2 is a view showing the construction of a punching unit 50 stored in the sheet processing apparatus 103.

FIG. 2 is a view showing the construction of the punching unit 50 in the sheet processing apparatus 103 (as seen from above this unit). The punching unit 50 is comprised of the sheet end detecting sensor 93 for detecting the end position of the sheet in the sheet width direction at a right angle to a sheet conveying direction A, and a punching section 90. The sheet end detecting sensor 93 is formed of a photocoupler having a light emitting part and a light receiving part to detect the sheet end when the sheet is interposed between the light emitting part and the light receiving part to block light from the light emitting part. In the present embodiment, the sheet end detecting sensor 93 and the punching section 90 are integrated together and configured so as to move together in a direction D-E at a right angle to the sheet conveying direction.

The punching section 90 is comprised of punches laterally projected from a peripheral surface of a rotary shaft 191 and dies 92 journaled to a rotary shaft 192 (see FIG. 3) extending parallel with the rotary shaft 191. The rotary shafts 191 and 192 are rotated synchronously by a punch drive motor, not shown.

Figure 3A:
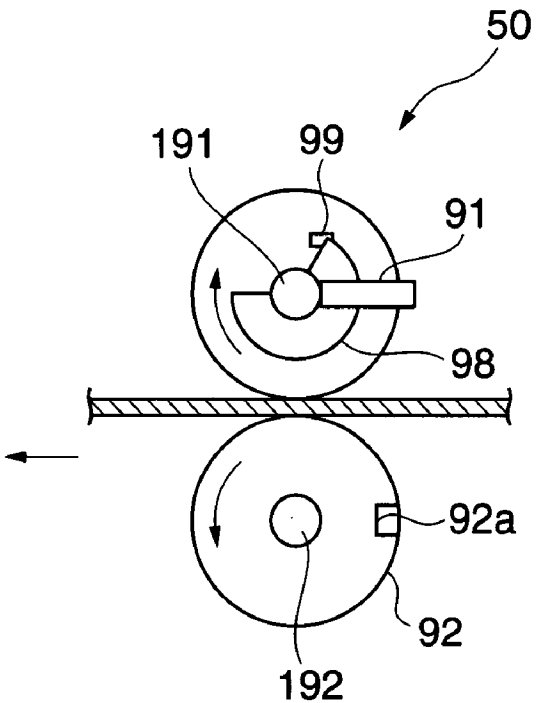
FIGS. 3A to 3C are views useful in explaining a punching operation performed by a punching unit 50.
Figure 3B:
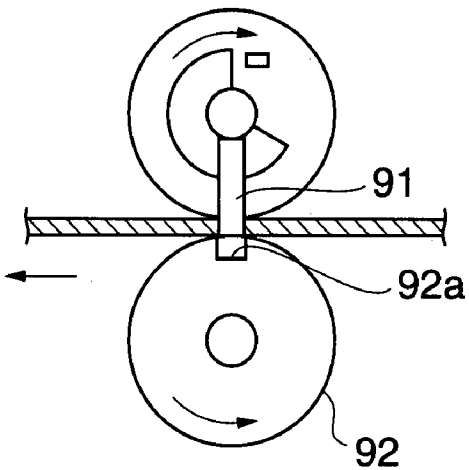
Figure 3C:
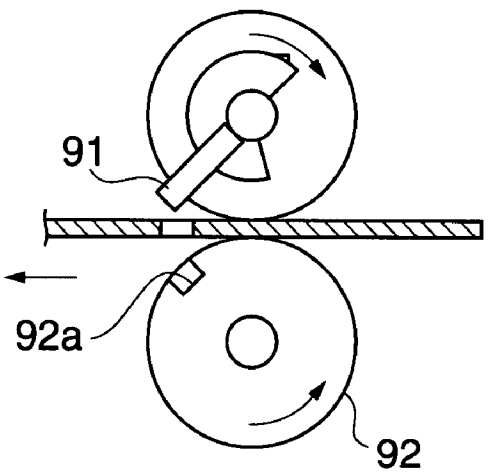

FIGS. 3A to 3C are views useful in explaining a punching operation performed by the punching unit 50. The punching unit 50 normally rests in a home position (HP), shown in FIG. 3A and is positioned in place by a punching position sensor 99 for detecting a punching position flag 98 attached to the rotary shaft 191. After the sheet detecting sensor 31 has detected the trailing end of the sheet, the punch drive motor is driven in predetermined timing to rotate the punches 91 and the dies 92 to engage each punch 91 with a die hole 92*a* formed in the corresponding die 92, thereby punching the sheet being conveyed (see FIG. 3B). Once the sheet being conveyed has been punched, each punch 91 is removed from the conveyance path (see FIG. 3C). In this punching operation, the sheet being conveyed can be punched by rotating the punches 91 and the dies 92 at the same speed as the pair of conveyance rollers 3.

The punching section 90 also has a punch slide HP detecting sensor 94 disposed for movement in the sheet width direction (the arrow D-E direction in FIG. 2) at a right angle to the sheet conveying direction A. When moved in the arrow E direction, the punch slide HP detecting sensor 94 detects a punch slide defining section 95 provided in the sheet processing apparatus 103. A punch slide HP is located several millimeters (corresponding to L2 in FIG. 2) before a sheet reference position; this distance corresponds to the amount of skewing or displacement of the sheet position in the direction (sheet width direction) at a right angle to the sheet conveying direction (hereinafter referred to as "the lateral registration".

The punching section 90 further includes the sheet end detecting sensor 93, and a lateral registration HP detecting sensor 96 which are driven by a sensor slide motor, not shown, to move in the arrow D or E direction. When moved in the arrow E direction, the lateral registration HP detecting sensor 96 detects a lateral registration HP defining section 97. Further, the sheet end detecting sensor 93 is moved in the arrow D direction and kept on standby at a sheet end detecting standby location corresponding to a selected sheet size. The sheet end detecting standby location is separated from the center of the punching unit 50 by a distance corresponding to half of the sheet width. In this manner, the sensor slide motor is driven before sheet conveyance to move the sheet end detecting sensor 93 to a location separated from the center of the punching unit 50 by the distance corresponding to half of the sheet width.

Upon passage of a predetermined period of time after the sheet detecting sensor 31 has detected a leading end of the sheet, a punch slide motor, not shown, is driven to move the punching section 90 and the sheet end detecting sensor 93 in the arrow D direction. Once the sheet end detecting sensor 93 has detected the sheet end when the space between the light emitting part and light receiving part of the sheet end detecting sensor 93 is blocked by the sheet, the punch slide motor is stopped. Thus, the punching position can be determined using the sheet end as a reference. At this time, adjustment of the punching position in the direction (the sheet width direction) at a right angle to the sheet conveying direction is completed. In this manner, the sheet end detecting sensor 93 determines the position to be punched so that the sheet can be punched at an appropriate position thereof, and the punching section 50 punches the sheet at a position thereof determined by a result of the detection by the sheet end detecting sensor 93. As described later, in the present embodiment, if the sheets to be punched have different sizes (for example, different sheet lengths in the conveying direction), then control is provided to correspondingly change the timing to move the punching section 90 and the sheet end detecting sensor 93 in the arrow D direction. That is, the above described predetermined period of time is changed depending on the size (for example, the sheet length in the conveying direction) of each of the plural kinds of sheets of difference sizes.

Figure 4:
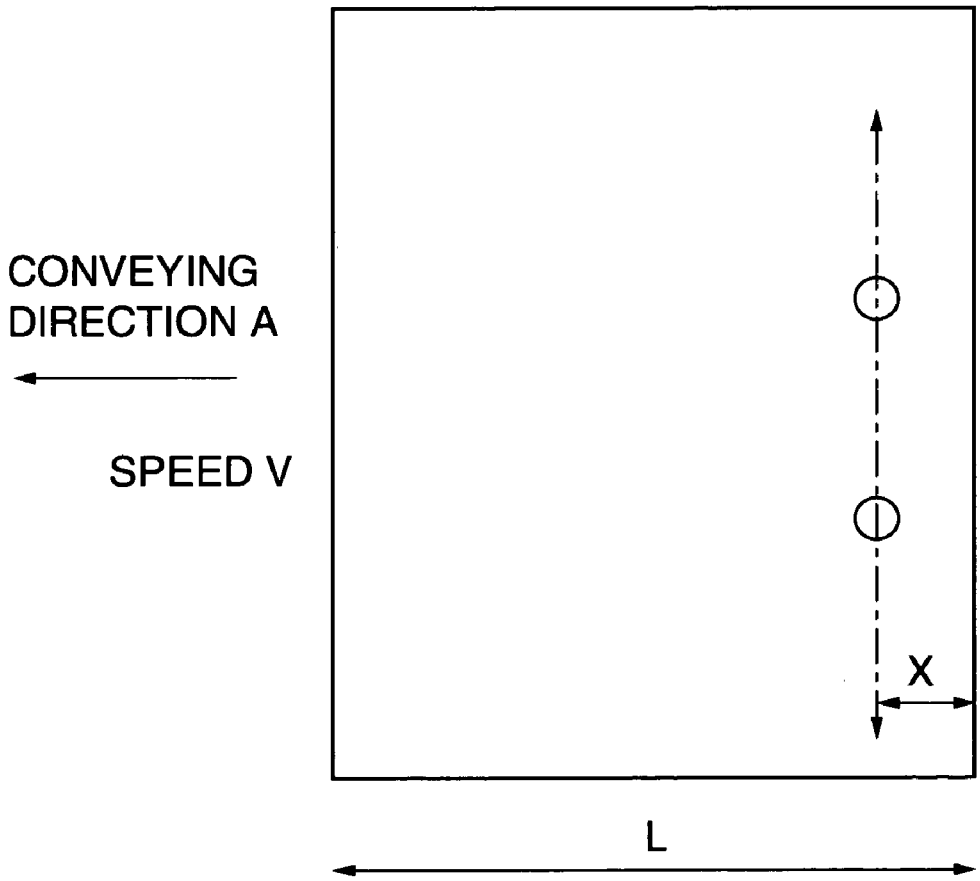
FIG. 4 is a view showing a punched sheet S.

Next, a description will be given of a manner of calculating the predetermined period of time T from detection of a leading end of the sheet S by the sheet detecting sensor 31 and before the punch slide motor, not shown, is driven. FIG. 4 is a view showing the punched sheet S. Here, the length (size) of the sheet in the sheet conveying direction A is defined as L, and the distance (punch offset) between the center of each punch hole and the trailing end of the sheet in the sheet conveying direction A is defined as X. Further, the distance between the sheet detecting sensor 31 and the sheet end detecting sensor 93 is defined as K (see FIG. 2), and the speed at which the sheet S is conveyed is defined as V.

A period of time T1 from detection of the leading end of the sheet S by the sheet detecting sensor 31 and before the punching position on the sheet S arrives at the sheet end detecting sensor 93 is shown by Equation (1):

$$T1=(K+L-X)/V \tag{1}$$

L2 (see FIG. 2) designates a maximum allowable range for skewing or lateral displacement of the sheet S. That is, L2 designates a maximum allowable range within which the sheet end can pass in the direction at a right angle to the sheet conveying direction A with respect to the center of sheet conveyance. The range L2 is set for the opposite sides of the center of sheet conveyance (the direction D-E). That is, if the amount of lateral displacement or skewing of the sheet exceeds a value corresponding to the range L2, the sheet is considered to have been improperly conveyed, and then control is provided to cancel the punching process or the like.

Further, if the speed at which the punch slide motor moves, that is, the speed at which the punching section 90 and the sheet end detecting sensor 93 move in the arrow D direction is defined as V2, a maximum period of time T2 required for the punching section 90 and the sheet end detecting sensor 93 to move is shown by Equation (2):

$$T2=(2\times L2)/V2 \tag{2}$$

Figure 5:
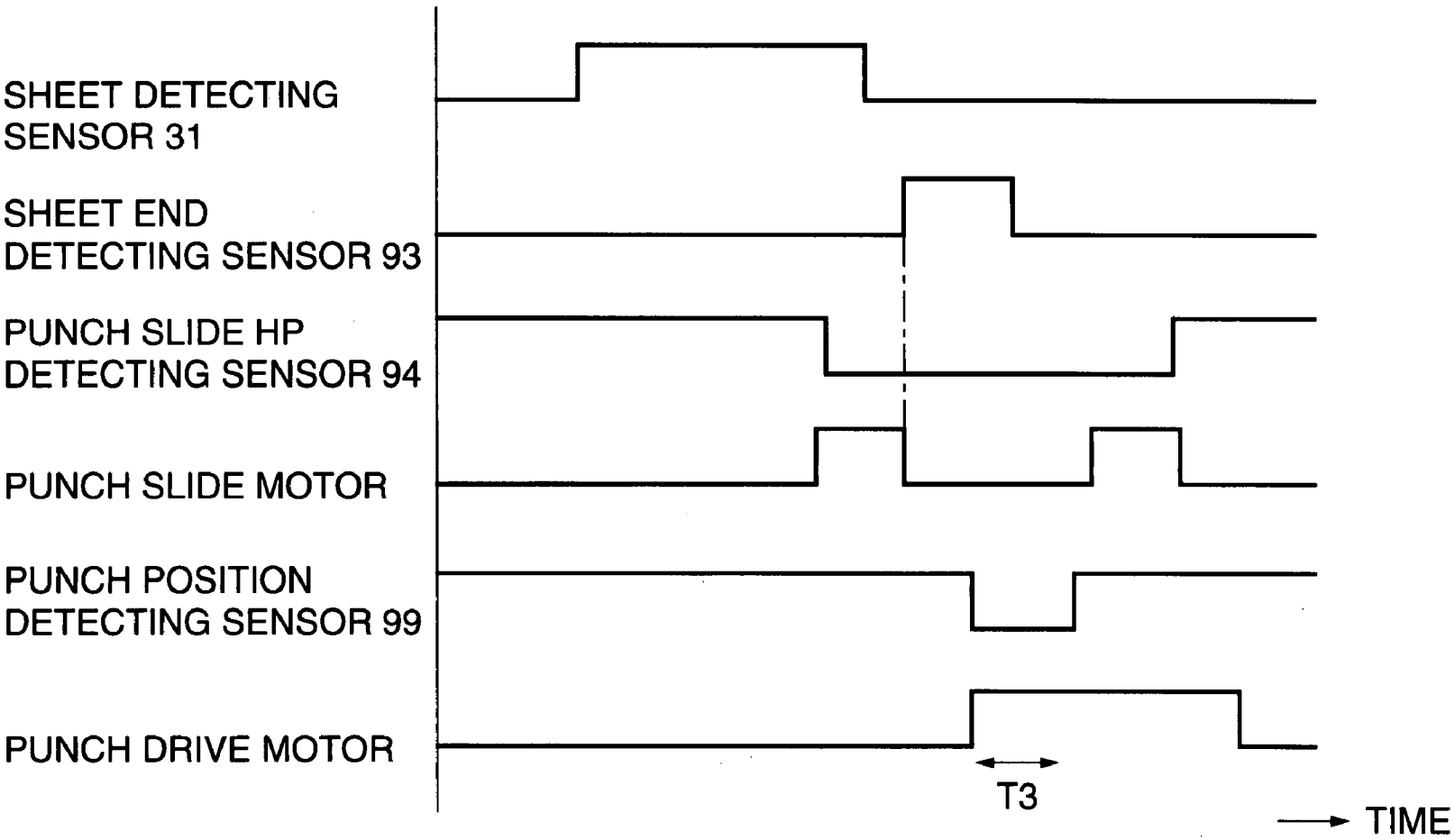
FIG. 5 is a timing chart showing signals from a sheet detecting sensor 31, a sheet end detecting sensor 93, a punch slide HP detecting sensor 94, and a punching position sensor 99, and driving waveforms for a punch drive motor, and a punch slide motor.

FIG. 5 is a timing chart showing signals from the sheet detecting sensor 31, the sheet end detecting sensor 93, the punch slide HP detecting sensor 94, and the punching position sensor 99, and driving waveforms for the punch drive motor, and the punch slide motor. In FIG. 5, T3 designates a period of time from start of driving of the punch drive motor and before each punch 91 and the corresponding die 92 are engaged together via the sheet being conveyed, to punch the same. T3 may designate a period of time from engagement of each punch 91 with the corresponding die 92 via the sheet being conveyed and before the sheet is punched. That is, the period of time T from detection of the sheet end in the conveying direction by the sheet detecting sensor 31 and before the punch slide motor (that moves the punching section 90 and the sheet end detecting sensor 93 as described above) is driven is shown by Equation (3):

$$T=T1-T2-T3 \tag{3}$$

where T meets T>K/V because the sheet end cannot be detected when the sheet does not actually arrive at the sheet end detecting sensor 93.

The above calculation result T is used as follows: For example, once the period of time T corresponding to the calculation result has passed after the sheet detecting sensor 31 detected the sheet end in the conveying direction, the punch slide motor is driven to start detection of the sheet end by the sheet end detecting sensor 93 (that is, the sheet end detecting sensor 93 is moved in the direction D to search for the sheet end. Since the punching section 90 and the sheet end detecting sensor 93 are integrated in one body, the punching section 90 also moves in the direction D). When the sensor 93 detects the sheet end, the positioning of the punching section 90 is completed to use as the punching position a position based on the detection result. Then, the sheet is punched by the punching section 90 at the position based on the detection result.

Based on the above description, a description will be given of the relationship between the size (the sheet length in the conveying direction) of the sheet to be punched, the period of time from the detection of the front end of the sheet in its conveying direction by the sheet detecting sensor 31 and before the sheet end detecting sensor 93 starts the sheet end detecting process, the position at which the sheet end detecting sensor 93 carries out the sheet end detecting process, and the period of time from the termination of the sheet end detecting process by the sheet end detecting sensor 93 and before the sheet is actually punched, using the following specific example: As sheets to be punched, for example, sheets of an A4 size will be compared with sheets of an A3 size which are larger in length in the sheet conveying direction than the A4 size sheets. The present embodiment provides such control that the timing in which the sheet end detecting sensor 93 starts the sheet end detection for A3-sized sheets (timing for start of movement of the sheet end detecting sensor 93 in the D direction) is delayed with respect to the timing in which the sheet end detecting sensor 93 starts the sheet end detection for A4-sized sheets. This is to always detect the end position of the sheet on the trailing end side thereof for any sizes of sheets if the sheets can be conveyed and punched by the apparatus, in order to detect the end position of the sheet with reference to the trailing end thereof. The reason why the trailing end is used as the reference is that the sheet is punched at the trailing end. That is, the present embodiment provides such control that the sheet end in the direction at a right angle to the sheet conveying direction is always detected at a vicinity of the punching position on the sheet to be punched (a point around the punching position) for any sizes (corresponding to the sheet length in the conveying direction) of sheets if the sheets can be conveyed and punched by the apparatus. For this reason, the period of time from the detection of the front end of the sheet in the conveying direction by the sheet detecting sensor 31 and before the sheet detecting sensor 93 starts the end detecting process is controlled to vary depending on the size (in the present embodiment, the sheet length in the conveying direction) of each of plural kinds of sheets of different sizes, so that, for example, the start timing for the sheet end detecting operation is advanced or delayed depending on the size of the sheet to be punched. The position where the sheet end detecting sensor 93 carries out the sheet end detecting process is always controlled to be on the trailing end side of the sheet, that is, near the punching position on the sheet to be punched (a point around the punching position) regardless of the sheet size, as described above, thereby allowing the sheet end to be always detected at the same point irrespective of the sheet size (that is, the distance between the position of the sheet detected by the sheet end detecting sensor 93 and the rearmost end position thereof is constant regardless of the sheet size).

Further, the period of time required before the sheet actually punched after the detection of the sheet end by the sheet end detecting sensor 93 is also controlled to be constant irrespective of the sheet size and can be significantly reduced by detecting the sheet end near the punching position on the sheet.

Since, the period of time required before the sheet is actually punched after the detection of the sheet end by the sheet end detecting sensor 93 is thus significantly reduced, even if the sheet to be punched skews or deviates in a lateral direction or whatever size the sheet has, a large difference is prevented from occurring between the amount of skewing at the time of detection of the sheet end and the amount of skewing at the time of actual punching of the sheet. Consequently, the appropriate position to be punched is prevented from being significantly changed to thereby minimize deviation of the punching position in the sheet width direction at a right angle with the sheet conveying direction.

Figure 6:
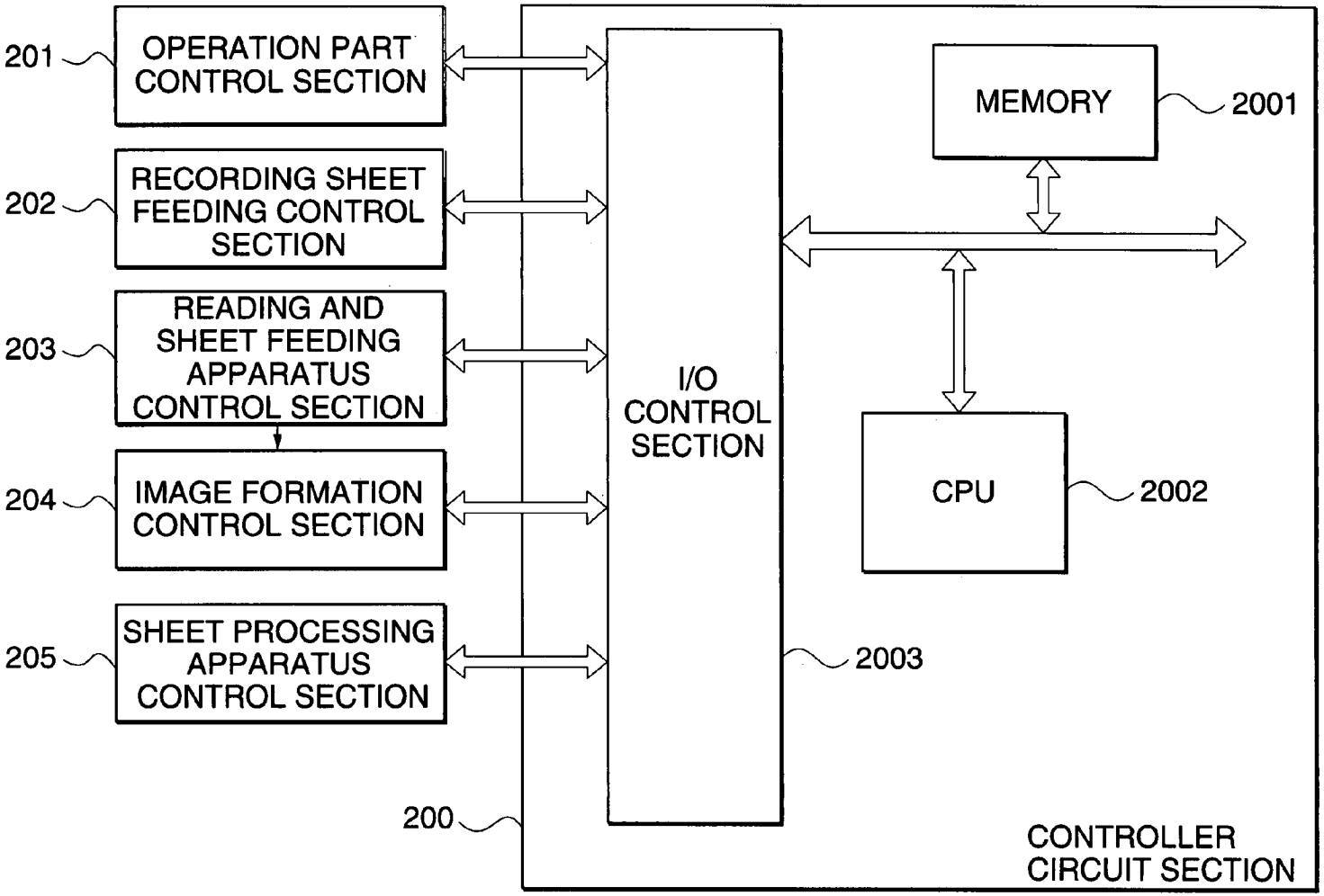
FIG. 6 is a block diagram showing the construction of a control section of the image forming system.

FIG. 6 is a block diagram showing the configuration of the control section of the image forming system. A controller circuit section 200 is comprised of a central processing unit (hereafter referred to as "the CPU") 2002, a memory 2001, an I/O control section 2003, and others. The CPU 2002 performs arithmetic operations in accordance with predetermined programs (including programs for executing various processes such as processes shown in flow charts, described later) and controls the entire system. The memory 2001 includes a RAM, a ROM, an IC card, a floppy disk, and the like for storing programs or predetermined data, to and from which programs (including the programs for executing various processes such as process shown in flow charts, described later) or data are written or read. The I/O control section 2003 transmits and controls input and output signals.

To the I/O control section 2003 are connected an operation section control section 201, a recording and sheet feeding control section 202, a reading and sheet feeding apparatus control section 203, an image formation control section 204, and a sheet processing apparatus control section 205.

The memory 2001 and the I/O control section 2003 are controlled by control signals from the CPU 2002. Further, the controller circuit section 200 causes the the operation section control 201, the recording paper feeding control section 202, the reading and feeding apparatus control section 203, the image formation control section 204, and the sheet processing apparatus control section 205 to operate via the I/O control section 2003.

With the image forming system configured as described above, when the user sets originals on the automatic original feeding section 51 of the reading and sheet feeding apparatus 101 and operates the operation section 40 of the image forming apparatus to set an operation mode and designate start of copying, the automatic original feeding section 51 sequentially feeds the originals to the read position on the original table glass 78 starting with the leading page and reads them using the optical system 52.

An original image is exposed by the CCD 76, and the exposed image is photoelectrically converted and read as an image signal. The read image signal is subjected to various image processes depending on the user's settings and is then converted into an optical signal for exposing the photosensitive body. Then, an image is formed on the sheet S through a typical electrophotographic process including an electric static charging step, an exposure step, a latent image forming step, a development step, a transfer step, a separation step, and a fixing step. The sheet S with the image formed thereon is switched back by the roller 64*a* into an upside-down position with its image formed surface facing downward, conveyed and discharged from the image forming apparatus 102 by means of the conveyance roller 65, and conveyed to the conveyance path of the sheet processing apparatus 103 via the inlet roller 1. The sheet processing apparatus 103 is controlled by the controller circuit section 200 in accordance with the settings via the operation section 40. The sheet S discharged from the image forming apparatus 102 is thus conveyed to the sheet processing apparatus 103.

If a punching operation mode has been selected by the operation section 40, the controller circuit section 200 actuates the sheet processing apparatus control section 205 to drive the sensor slide motor to move the sheet end detecting sensor 93 to a predetermined position (sheet end detection standby position) appropriate for the sheet size before starting sheet conveyance.

When the sheet detecting sensor 31 detects the front end of the sheet, the controller circuit section 200 calculates from the sheet length in the conveying direction a period of time it must wait (hereinafter referred to as "the wait time") before starting punch slide driving and then actuates a timer (this wait time varies depending on the sheet length in the conveying direction as described above). If the controller circuit section 200 determines that the punch slide driving wait time has elapsed, it actuates the sheet processing apparatus control section 205 to drive the punch slide motor to move the punching section 90 and the sheet end detecting sensor 93 in the sheet width direction (the arrow D direction in FIG. 2). When the sheet end detecting sensor 93 detects the sheet end, the controller circuit section 200 stops the punch slide motor to thereby position the punching section 90 and the sheet end detecting sensor 93.

When the sheet detecting sensor 93 detects the trailing end of the sheet, the controller circuit section 200 calculates, based on the punch offset (X) corresponding to the punching position on the sheet 5, the wait time before starting punch slide driving, and then actuates the timer. When the calculated wait time has elapsed, the controller circuit section 200 drives the punch drive motor, not shown, to rotatively drive the punches 91 and dies 92 of the punching section 90 to punch the sheet S.

When the punching position sensor 99 detects completion of the punching operation, the controller circuit section 200 actuates the sheet processing apparatus control section 205 to drive the punch slide motor, not shown, to move the punching section 90 and the sheet end driving sensor 93 in the punch slide HP direction (the arrow E direction in FIG. 2).

When the punch HP detecting sensor 94 detects the punch slide HP defining section 95, the controller circuit section 200 actuates the sheet processing apparatus control section 205 to stop the punch slide motor, not shown, to set the punching section 90 and the sheet end detecting sensor 93 on standby.

The controller circuit section 200 also actuates the sheet processing apparatus control section 205 to drive the conveyance flapper 11 to switch the conveyance path. If the sheet S is to be loaded on the sample tray 85, it is discharged via the discharging roller 9. If the sheet S is to be loaded on the stack tray 86, it is discharged from the discharging roller 7 via the conveyance roller 6 onto the processing tray 82.

If a stapling operation has been selected by the operation section 40, the controller circuit section 200 actuates the sheet processing apparatus control section 205 to drive the staple unit 80 to staple the trailing end of the bundle of sheets loaded on the processing tray 82. The controller circuit section 200 also actuates the sheet processing apparatus control section 204 to drive the aligning plate 88 to align the bundle of sheets to be loaded, while controlling a direction in which the bundle of sheets to be loaded on the stack tray 86 are arranged. Further, the controller circuit section 200 actuates the sheet processing apparatus control section 205 to close the pivotal guide 81 and then drive the bundle discharging roller (the upper discharging roller 83*a* and the lower discharging roller 83*b*) to discharge and load the bundle of sheets from the processing tray 82 onto the stack tray 86.

Figure 7:
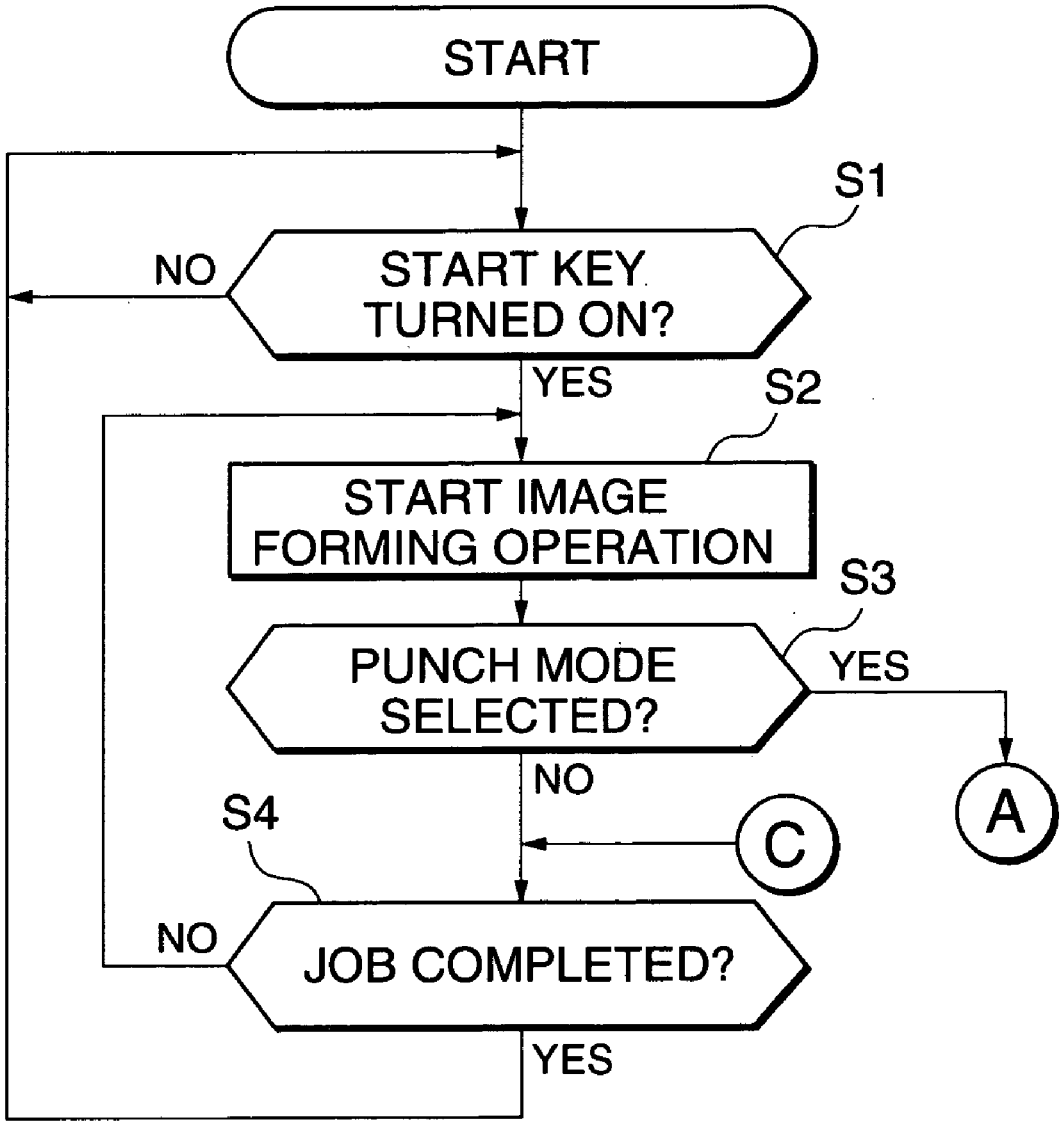
FIG. 7 is a flow chart showing a procedure of a punching operation process according to the first embodiment.
Figure 8:
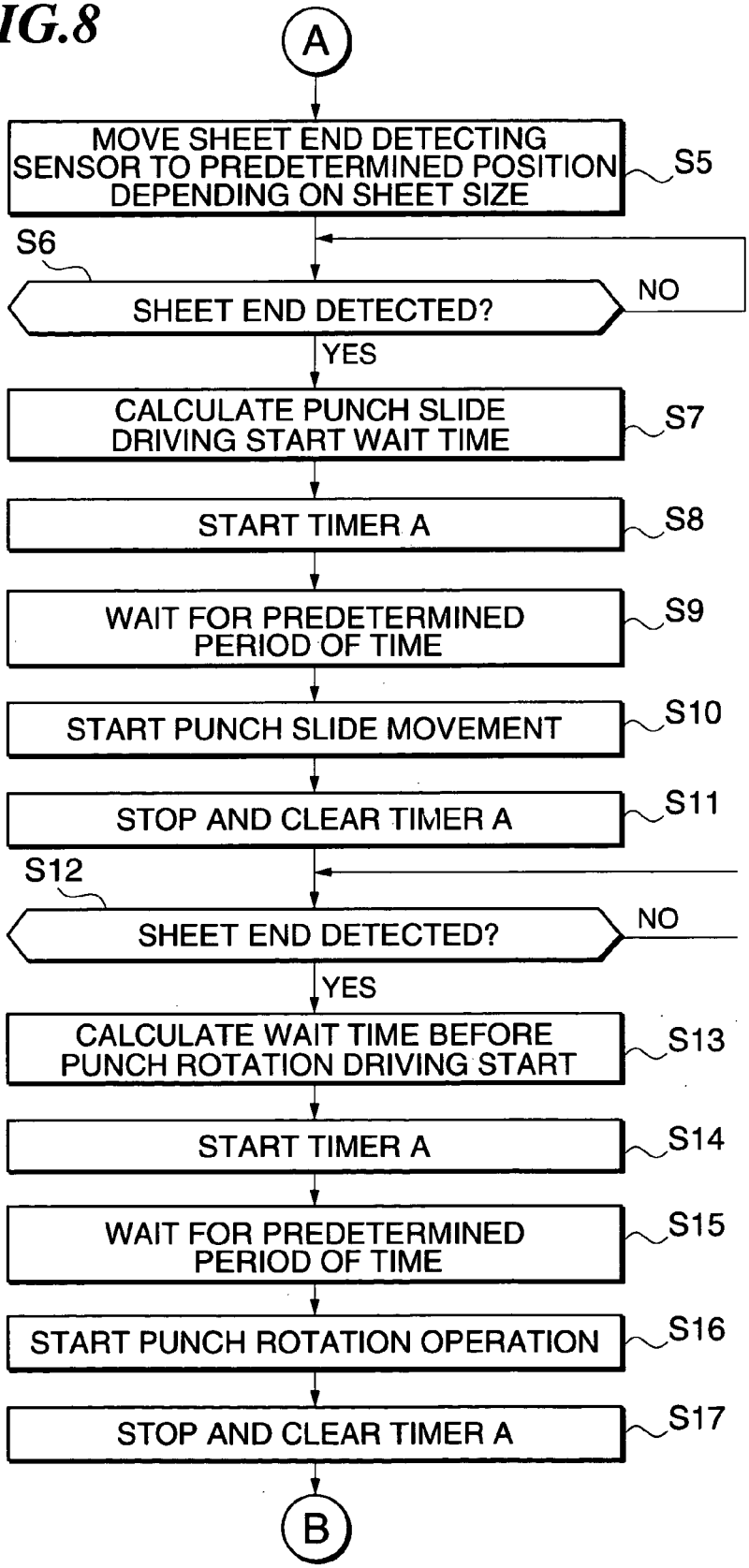
FIG. 8 is a flow chart showing a continued part of the procedure of the punching operation process from FIG. 7.
Figure 9:
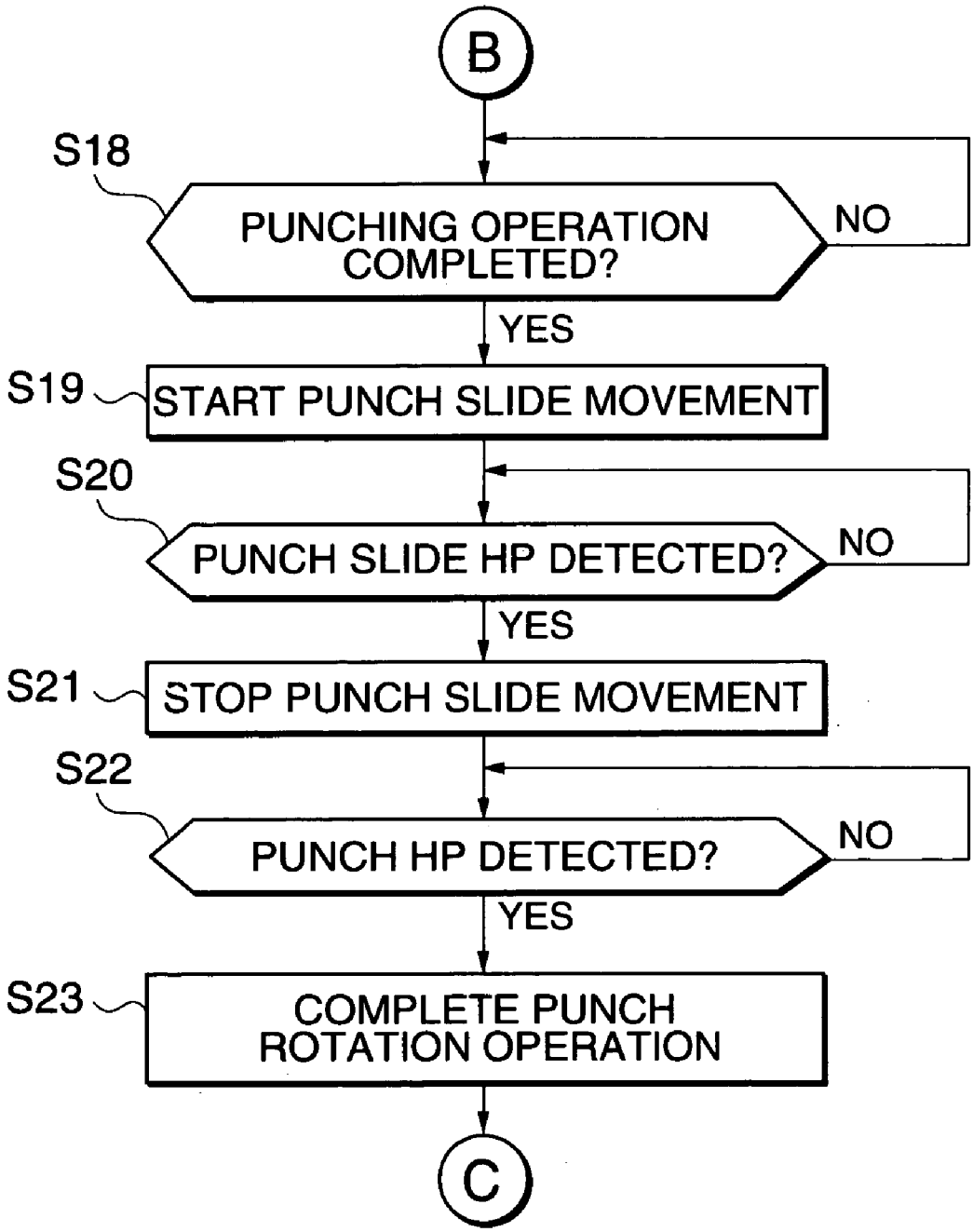
FIG. 9 is a flow chart showing a continued part of the procedure of the punching operation process from FIGS. 7 and 8.

FIGS. 7, 8, and 9 are flow charts showing a procedure of the punching operation process. A program for executing this process is stored in the ROM in the memory 2001 and executed by the CPU 2002.

The CPU 2002 actuates the operation section control section 201 to receive inputs for the loading, stapling, and punching operations, and actuates the recording paper feeding control section 202, the reading and sheet feeding apparatus control section 203, the image formation control section 204, and the sheet processing apparatus control section 205 based on the operational settings designated by the user's inputs to the operation section 40.

That is, first, the CPU 2002 determines whether or not the user has selected a copy start operation, that is, whether or not a copy start key has been turned on (step S1). If the CPU determines that the copy start has been turned on, it starts an image forming operation (step S2).

The CPU 2002 determines whether or not the user has selected a punching operation mode before the user selects the copy start operation (step S3). If the CPU 2002 determines that the user has not selected the punching operation mode, it then determines whether or not the job has been completed (step S4).

If the CPU 2002 determines that the job has been completed, it returns to the processing at the step S1. On the other hand, if the CPU 2002 determines that the job has not been completed, it returns to the processing at the step S2 to continue the image forming operation.

On the other hand, if the user has selected the punching operation at the step S3, the CPU 2002 actuates the sheet processing apparatus control section 205 to drive the sensor slide motor to move the sheet end detecting sensor 93 to the predetermined position (the sheet end detection standby position) appropriate for the sheet size (step S5). Then, the CPU 2002 waits until the sheet detecting sensor 31 detects the front end position of the sheet (step S6).

When the leading end of the sheet is detected, the CPU 2002 calculates from the sheet conveyance length the wait time before starting punch slide driving (step S7). Once the CPU 2002 has cleared a timer A inside the CPU, it starts the punch slide driving (step S8). The value calculated at the step S7 varies depending on the size of each sheet (the sheet length in the conveying direction) as described above.

The CPU 2002 waits until the timer A counts up the wait time before starting the punch slide driving (step S9). Once the punch slide driving wait time has elapsed, the CPU 2002 actuates the sheet processing apparatus control section 205 to drive the punch slide motor to start moving the punching section 90 and the sheet end detecting sensor 93 in the sheet width direction (the arrow D direction in FIG. 2) so that the sheet end detecting sensor 93 can detect the sheet end (step S10). Subsequently, the CPU 2002 stops and clears the timer A (step S11).

Figure 10:
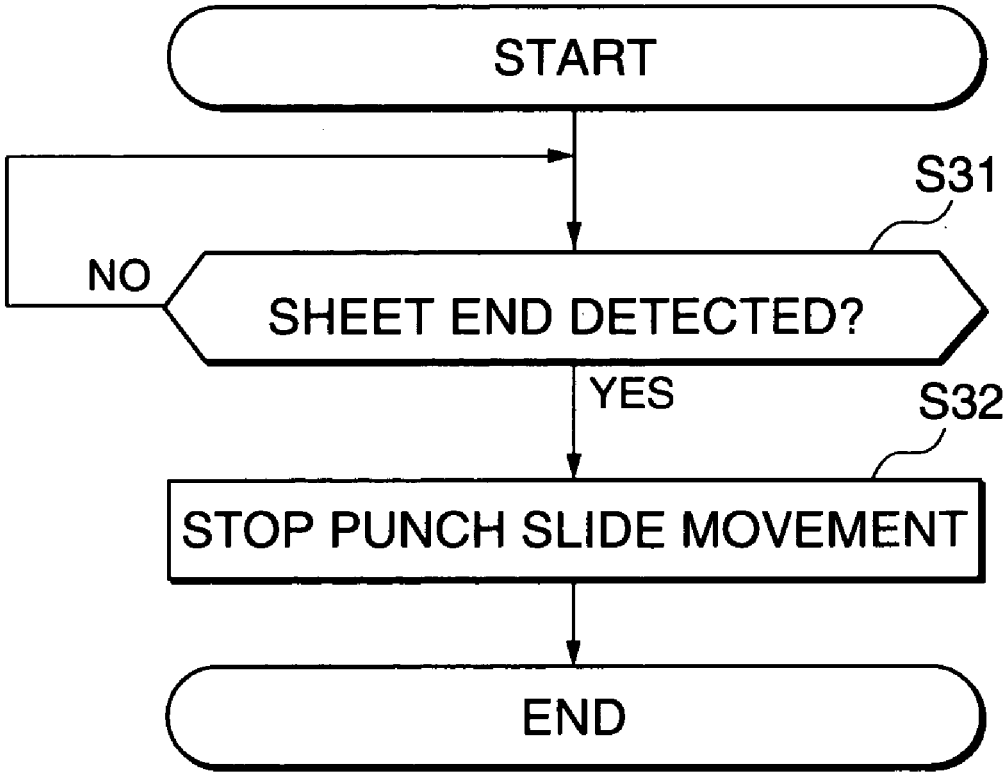
FIG. 10 is a flow chart showing a procedure of a sheet end detecting process.

When the punching section 90 and the sheet end detecting sensor 93 start moving in the sheet width direction at the step S10, the sheet end detecting process is started. FIG. 10 is a flow chart showing a procedure of the sheet end detecting process. A program for executing this process is stored in the ROM in the memory 2001 and executed by the CPU 2002 in parallel with the process shown in FIGS. 7, 8, and 9. That is, the CPU 2002 waits until the sheet end detecting sensor 93 detects the sheet end (step S31). If the sheet end is detected, the CPU 2002 stops the punch slide motor to stop the movement of the punching section 90 and sheet end detecting sensor 93 (step S32) to complete the processing. The above processing completes the adjustment of the punching position in the sheet width direction at a right angle with the conveying direction.

On the other hand, after clearing the timer A at the step S11, the CPU 2002 waits until the sheet detecting sensor 31 detects the trailing end of the sheet (step S12). When the trailing end of the sheet is detected, the CPU 2002 calculates the wait time before starting punch rotation driving, depending on the preset punching position (the position at the distance X from the trailing end of the sheet) in the sheet conveying direction (step S13). The CPU 2002 starts the timer A (step S14) and waits until the timer A counts up the wait time before starting the punch rotation driving (step S15). The CPU 2002 then actuates the sheet processing apparatus control section 205 to drive the punch drive motor to punch the trailing end of the sheet being conveyed (step S16). Then, the CPU 2002 stops and clears the timer A (step S17).

The CPU waits until the punching position detecting sensor 99 detects completion of the punching (step S18). When the completion of the punching is detected, the CPU 2002 actuates the sheet end apparatus control section 205 to drive the punch slide motor to move the punching section 90 and the sheet end detecting sensor 93 to the punch slide HP (step S19).

The CPU waits until the punch slide HP sensor 94 detects the punch slide HP defining section 95 (step S20). When the punch slide HP defining section 95 is detected, the CPU 2002 stops the movement of the punching section 90 and sheet end detecting sensor 93 toward the punch slide HP (step S21).

The CPU 2002 waits until the punching position detecting sensor 99 detects the punch HP (step S22). When the punch HP is detected, the CPU 2002 stops the rotative movement of the punches 91 and dies 92 (step S23) and returns to the processing at the step S4.

Subsequently, as described above, the CPU 2002 determines at the step S4 whether or not this job has been completed. If the CPU 2002 determines that the job has been completed, it returns to the processing at the step S1 to prepare for the next job. On the other hand, if the CPU 2002 determines at the step S4 that the job is to be continued, it executes the processing at the step S2 to continue the image forming operation.

As described above, according to the image forming system of the first embodiment, based on the information on the length of the sheet width (the sheet length in the conveying direction), the sheet end detecting sensor is first moved to the sheet end detection standby position, and then, to detect the sheet end, the sensor 93 is moved from the sheet end detection standby position in the timing of the movement of the punching position on the sheet to the predetermined position regardless of the length of the sheet to be detected (that is, to enable the sheet end to be detected near the actually punching position, the timing in which the sheet end detecting sensor 93 starts moving is changed depending on the length of each sheet in the conveying direction). By completing the punch slide movement and performing the punching operation when the sheet end detecting sensor 93 detects the sheet end, deviation of the punching position in the sheet width direction at a right angle with the sheet conveying direction can be minimized to provide a higher-grade sheet processing apparatus for the user.

(Second Embodiment)

An image forming system according to a second embodiment of the present invention has the same mechanical and electrical constructions as those of the first embodiment, and description thereof is therefore omitted. A punching operation in the second embodiment which is different from that in the first embodiment will be principally explained below.

In the second embodiment, a sheet size that enables the sheet to be punched can be determined from the sheet length in the conveying direction. FIG. 4, referred to above, shows a sheet with a minimum punchable sheet length in the conveying direction, and the sheet is shown to have been punched.

That is, let it be assumed that the minimum punchable length in the sheet conveying direction is defined as L, and the distance (punch offset) between the center of each punch hole and the trailing end of the sheet in the conveying direction A is defined as X. Further, let it be assumed that the distance between the sheet detecting sensor 31 and the punching section 90 is defined as M (see FIG. 2), the distance between the sheet detecting sensor 31 and the sheet end detecting sensor 93 is defined as K, and the speed at which the sheet is conveyed is defined as V.

The period of time T1 from the detection of the trailing end of the sheet by the sheet detecting sensor 31 and before the punching position on the sheet arrives at the punching section 90 is shown by Equation (4):

$$T1=(M-X)/V \tag{4}$$

In FIG. 5, referred to above, T3 designates the period of time from the start of driving of the punch drive motor and before each punch 91 and the corresponding dice 92 are engaged with each other via the sheet being conveyed to punch the sheet. That is, to enable punching the punching position by driving the punch drive motor after the sheet detecting sensor 31 has detected the trailing end of the sheet, Equation (5) must be satisfied.

$$T1>T3 \tag{5}$$

L2 (see FIG. 2) designates the maximum allowable range for skewing or lateral displacement of the sheet S. That is, L2 designates the maximum allowable range within which the sheet end can pass in the width direction at a right angle to the sheet conveying direction A with respect to the center of sheet conveyance. The range L2 is set for the opposite sides of the center of sheet conveyance (the direction D-E). Further, if the speed of the punch slide motor is defined as V2, the maximum period of time T2 required for the punch slide movement is shown by Equation (2), referred to above:

$$T2=(2\times L2)/V2 \tag{2}$$

In actuality, for the sheet end detecting sensor 93 to detect the sheet end, the punching section 90 and the sheet end detecting sensor 93 must be able to move a distance 2×L2 while the sheet is passing the sheet end detecting sensor 93. That is, Equation (6) must be satisfied:

$$T2<(L-X)/V-T3 \tag{6}$$

Figure 11A:
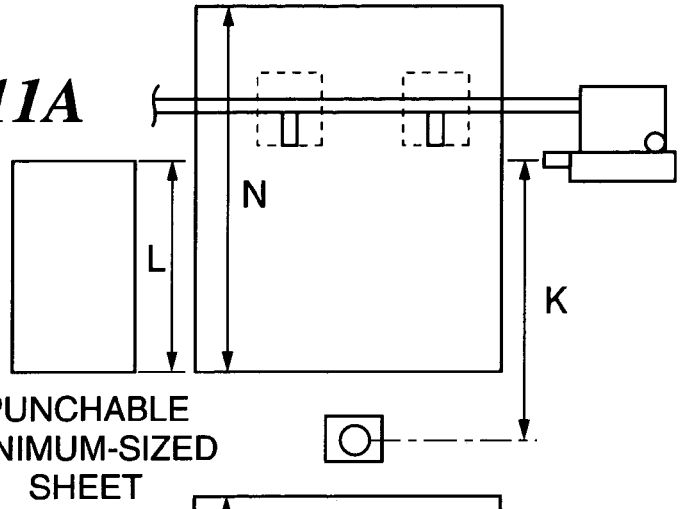
FIGS. 11A to 11C are views showing the relationship between a minimum punchable length L of a sheet in a sheet conveying direction and a distance K between the sheet detecting sensor 31 and the sheet end detecting sensor 93 according to a second embodiment of the present invention, in respective cases where K>L, K=1, and K<L.
Figure 11B:
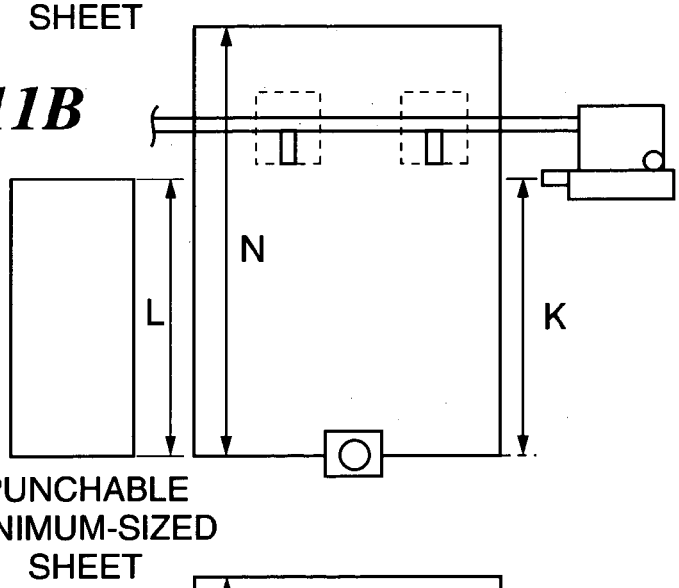
Figure 11C:
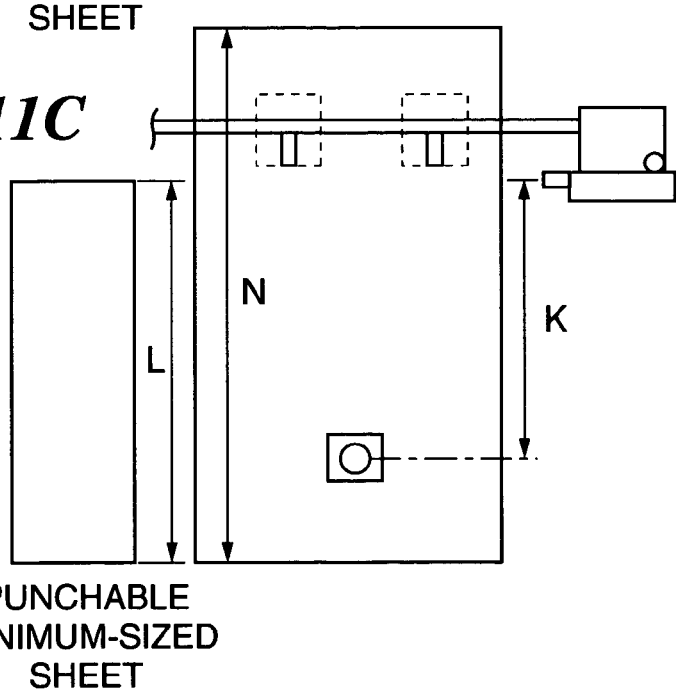

Next, the relationship between the minimum punchable length L in the sheet conveying direction and the distance K between the sheet detecting sensor 31 and the sheet end detecting sensor 93 is shown. FIGS. 11A to 11C are views showing the relationship between the minimum punchable length L in the sheet conveying direction and the distance K between the sheet detecting sensor 31 and the sheet end detecting sensor 93. The length of the sheet to be punched in the conveying direction is defined as N(N>L).

FIG. 11A shows a case where K>L. In this case, after the sheet detecting sensor 31 has detected the trailing end of the sheet, the amount of sheet movement is detected. The amount of sheet movement can be detected, for example, by detecting a clock for driving the sheet conveyance motor. By counting clocks corresponding to (K−L) after the sheet detecting sensor 31 has detected the trailing end of the sheet, it is possible to determine that the distance between the trailing end of the sheet and the sheet end detecting sensor 93 is equal to the minimum length L of the sheet in the conveying direction. Then, driving of the punch slide motor, not shown, is started.

Alternatively, the speed V of the sheet conveyance motor may be used. That is, by counting a period of time (K−L)/V by a timer after the sheet detecting sensor 31 has detected the trailing end of the sheet, it is possible to determine that the distance between the trailing end of the sheet and the sheet end detecting sensor 93 is equal to the minimum length L of the sheet in the conveying direction. Then, driving of the punch slide motor, not shown, is started.

FIG. 11B shown a case where K=L. In this case, immediately after the sheet detecting sensor 31 has detected the trailing end of the sheet, driving of the punch slide motor (not shown) is started. FIG. 11C shows a case where K<L. In this case, after the sheet detecting sensor 31 has detected the leading end of the sheet, the amount of sheet movement is detected. The amount of sheet movement can be detected, for example, by detecting the clock for driving the sheet conveyance motor. By counting clocks corresponding to (N+K−L) after the sheet detecting sensor 31 has detected the leading end of the sheet, it is possible to determine that the distance between the trailing end of the sheet and the sheet end detecting sensor 93 is equal to the minimum length L of the sheet in the conveying direction. Then, driving of the punch slide motor, not shown, is started. Alternatively, the speed V of the sheet conveyance motor, may be used. That is, by counting a period of time (N+K−L)/V by a timer after the sheet detecting sensor 31 has detected the trailing end of the sheet, it is possible to determine that the distance between the trailing end of the sheet and the sheet end detecting sensor 93 is equal to the minimum length L of the sheet in the conveying direction. Then, driving of the punch slide motor, not shown, is started. Then, the punch slide motor, not shown, is driven to move the punching section 90 and the sheet end detecting sensor 93 in the arrow D direction, so that the space between the light emitting and receiving parts of the sheet end detecting sensor 93 is blocked by the sheet to thereby detect the sheet end, immediately followed by stopping the punch slide motor. Thus, the punching position can be aligned with the punching section 90 with reference to the sheet end.

In this manner, if the relationship between the minimum punchable length L in the sheet conveying direction and the distance K between the sheet detecting sensor 31 and the sheet end detecting sensor 93 is $K \geqq L$ as shown in FIGS. 11A and 11B, the sheet detecting sensor 31 detects the trailing end of the sheet, and if the relationship is $K<L$ as shown in FIG. 1C, the sheet detecting sensor 31 detects the leading end of the sheet. Then, the controller circuit section 200 waits until the distance K between the trailing end of the sheet and the sheet end detecting sensor 93 becomes equal to the minimum punchable length L in the sheet conveying direction. This can be determined from the sheet conveyance speed and the data on the sheet length in the conveying direction, as described above. Alternatively, it can be determined by counting clocks for driving the sheet conveyance motor.

If the controller circuit section 200 determines that the distance between the trailing end of the sheet and the sheet end detecting sensor 93 equals the minimum punchable length L in the sheet conveying direction, the sheet processing apparatus control section 204 is actuated to drive the punch slide motor to move the punching section 90 and the sheet end detecting sensor 93 in the sheet width direction (the arrow D direction in FIG. 2). When the sheet end detecting sensor 93 detects the sheet end, the controller circuit section 200 stops the punch slide motor to thereby position the punching section 90 and the sheet end detecting sensor 93.

As described above, the present embodiment provides such control that it is checked whether or not the distance between sheet end sensor 93 and the trailing end of the sheet being conveyed equals a predetermined length (predetermined distance) and the sheet end detecting sensor 93 is caused to start an end detecting operation depending upon a check result. The present invention also provides such control that the sheet end detecting sensor 93 is caused to start the end detecting operation depending upon how far the sheet has been conveyed after the sheet detecting sensor 31 detected the front end of the sheet. A specific example will be described below.

For example, if the predetermined length is assumed to be and an A4-sized sheet is to be punched, since the length of this sheet in the conveying direction is 210 mm, 210−185=25 mm, that is, the sheet end detecting sensor 93 is caused to start detecting the sheet end when the sheet is conveyed by 25 mm downstream in the sheet conveying direction after the sheet detecting sensor 31 detects the leading end of the sheet. Further, if, for example, an A3-sized sheet is to be punched, since the length of this sheet in the conveying direction is 420 mm, 420−185=135 mm, that is, the sheet end detecting sensor 93 is caused to start detecting the sheet end when the sheet is conveyed by 135 mm downstream in the sheet conveying direction after the sheet detecting sensor 31 detects the leading end of the sheet.

Thus, the sheet end can be detected near the actually punching position irrespective of the sheet length in the conveying direction. If the sheet is displaced in the lateral direction or skews, as the position where the sheet end is detected is closer to the actually punching position, the difference between the amount of skewing at the time of detection of the sheet end and the amount of skewing at the time of actual punching can be reduced, thereby reducing deviation of the punching position in the sheet width direction. Therefore, insofar as a period of time sufficient is allowed for detecting the sheet end before the punching process, the sheet end is detected at a position as close to the punched position as possible.

Referring to FIG. 2, the distance K between the sheet detecting sensor 31 and the sheet end detecting sensor 93 is stored in the memory beforehand as mechanical configuration data. In addition, the data on the sheet length in the conveying direction can be obtained beforehand from setting information from the operator, including setting information on sheet selection in the operation section (for example, the data on the sheet length in the conveying direction may be obtained by providing a sensor similar to the sheet detecting sensor 31 on an upstream side in the sheet conveying direction and measuring a period of time from the arrival of the leading end of the sheet at this sensor and before the sheet passes through the sensor). Thus, the present embodiment is configured such that the distance K between the sheet detecting sensor 31 and the sheet end detecting sensor 93 and the data on the length of the sheet to be punched in the conveying direction can be obtained beforehand, whereby the distance between the trailing end of the sheet being conveyed and the sheet end detecting sensor 93 can be properly checked.

Figure 12:
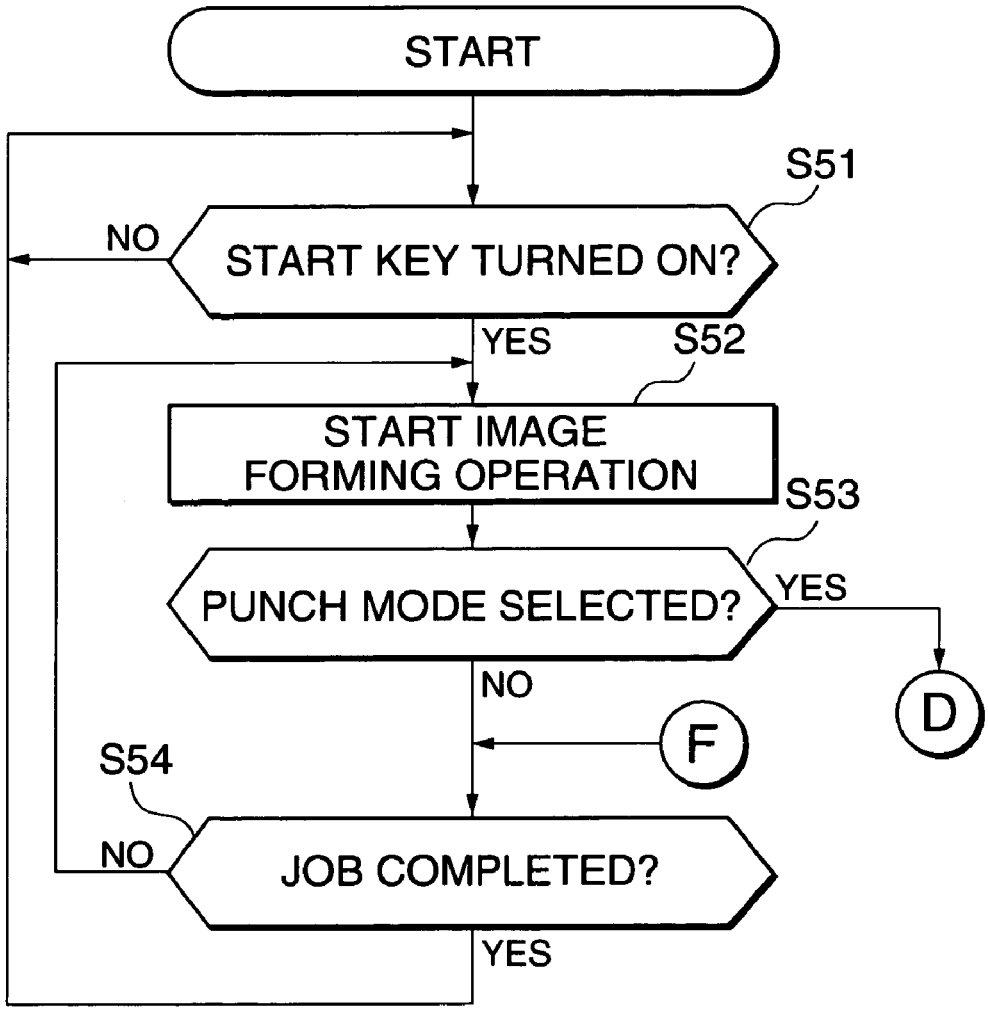
FIG. 12 is a flow chart showing a procedure of a punching operation process according to the second embodiment.
Figure 13:
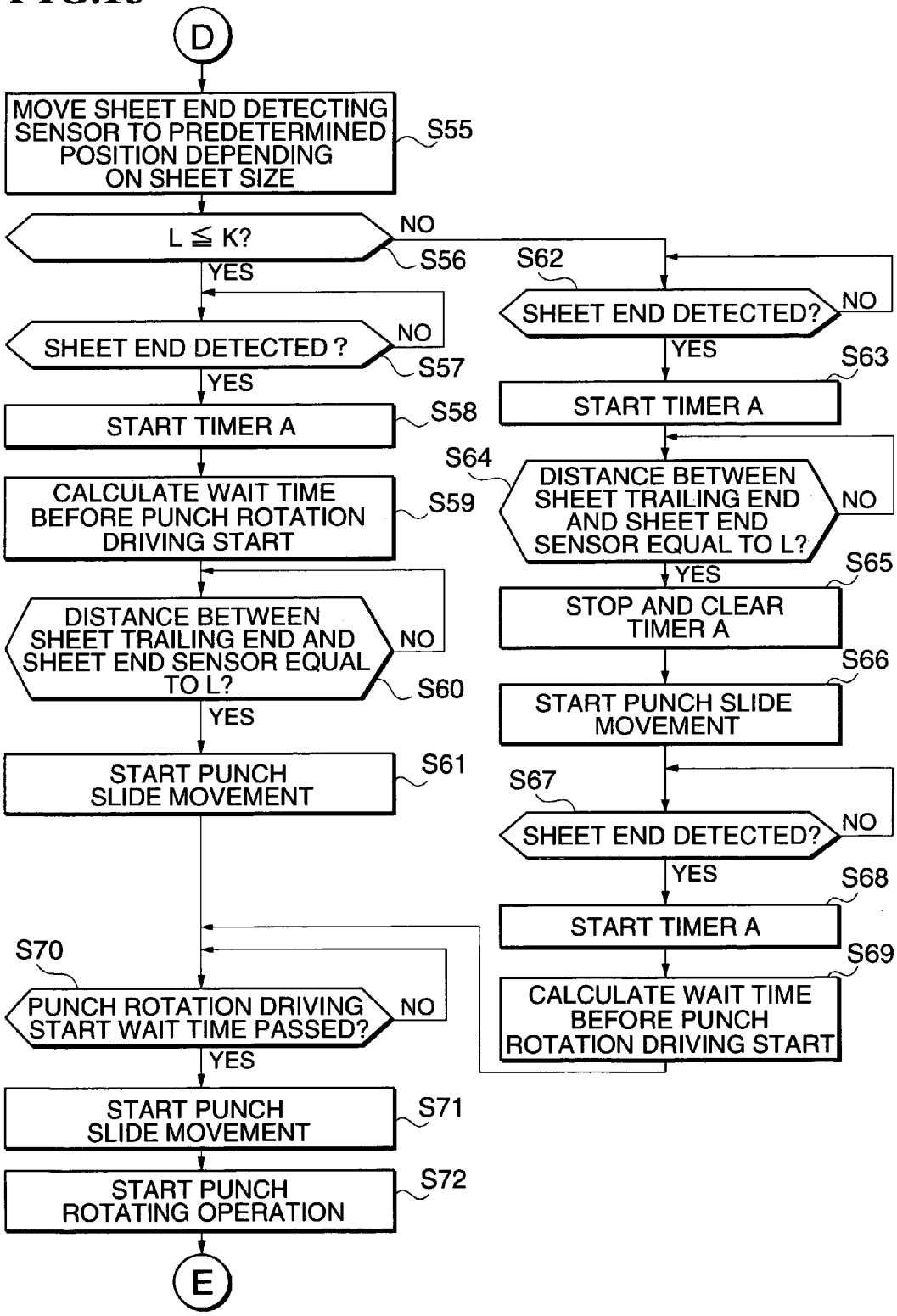
FIG. 13 is flow chart showing a continued part of the procedure of the punching operation process from FIG. 12.
Figure 14:
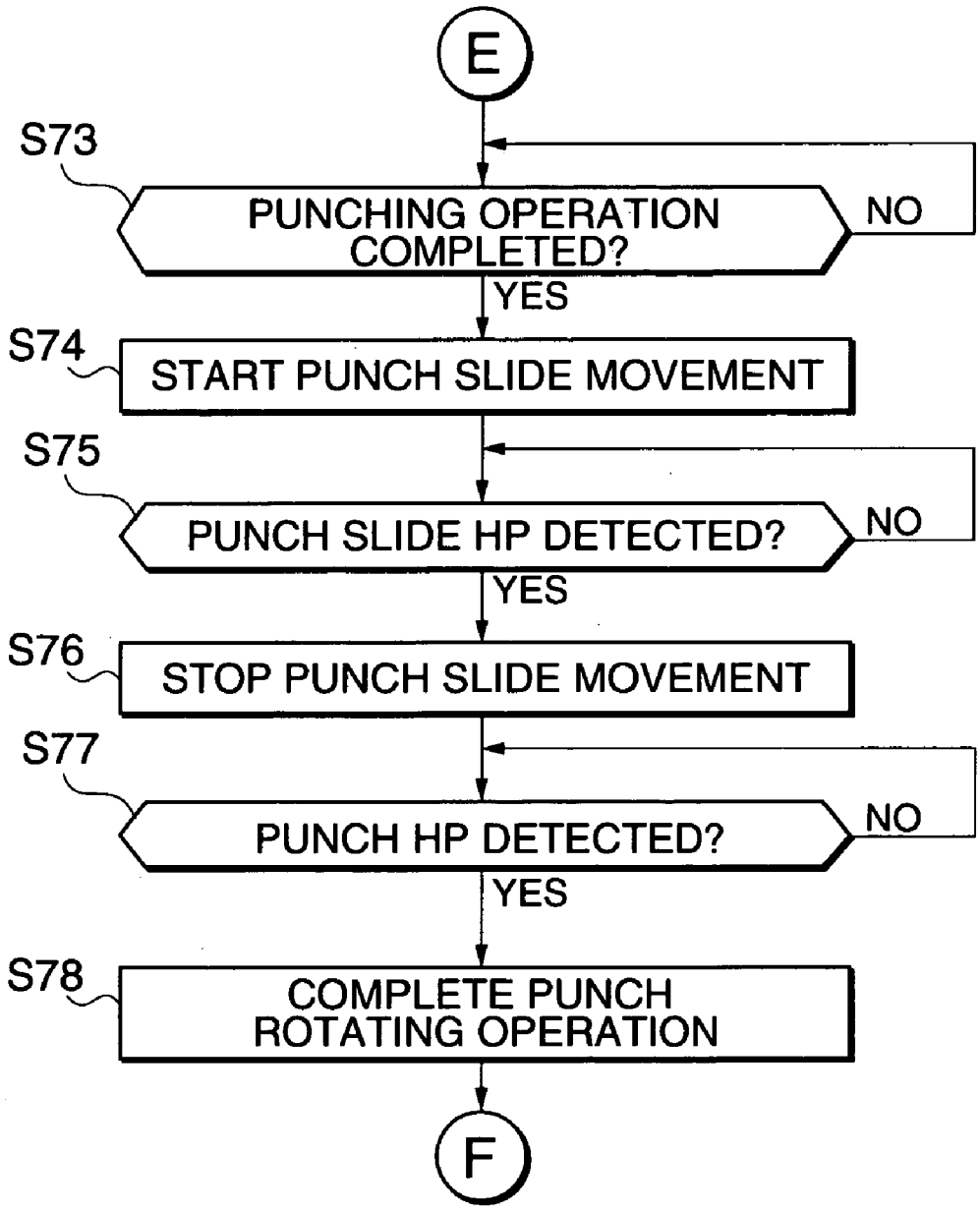
FIG. 14 is a flow chart showing a continued part of the procedure of the punching operation process from FIGS. 12 and 13.

FIGS. 12, 13, and 14 are flow charts showing a procedure of the punching operation process. A program for executing this process is stored in the ROM in the memory 2001 and is executed by the CPU 2002.

The CPU 2002 actuates the operation section control section 201 to receive inputs for the loading, stapling, and punching operations, and actuates the recording paper feeding control section 202, the reading and sheet feeding apparatus control section 203, the image formation control section 204, and the sheet processing apparatus control section 205 based on the operational settings designated by the user's inputs to the operation section 40.

That is, first, the CPU 2002 determines whether or not the user has selected the copy start operation, that is, whether or not the copy start key has been turned on (step S51). If the CPU determines that the copy start has been turned on, it starts an image forming operation (step S52).

The CPU 2002 determines whether or not the user has selected the punching operation before the user selects the copy start operation (step S53). If the CPU 2002 determines that the user has not selected the punching operation, it then determines whether or not the job has been completed (step S54).

If the CPU 2002 determines that the job has been completed, it returns to the processing at the step S51. On the other hand, if the CPU 2002 determines that the job has not been completed, it returns to the processing at the step S52 to continue the image forming operation.

On the other hand, if the user has selected the punching operation at the step S53, the CPU 2002 actuates the sheet processing apparatus control section 205 to drive the sensor slide motor to move the sheet end detecting sensor 93 to the predetermined position (the sheet end detection standby position) appropriate for the sheet size (step S55).

Then, the CPU 2002 determines whether the distance K between the sheet detecting sensor 31, and the sheet end detecting sensor 93 is equal to or larger than the minimum punchable length L in the sheet conveying direction (step S56). If the CPU 2002 determines that the distance K between the sheet detecting sensor 31 and the sheet end detecting sensor 93 is equal to or larger than the minimum punchable length L in the sheet conveying direction, it waits until the sheet detecting sensor 31 detects the trailing end of the sheet (step S57). When the sheet detecting sensor 31 detects the trailing end of the sheet, the CPU 2002 starts the timer A (step S58), and calculates the wait time before starting the punch rotation driving, depending upon the predetermined punching position (the position at the distance X from the trailing end of the sheet) in the sheet conveying direction (step S59).

The CPU 2002 waits until the timer A counts up the wait time (K−L)/V before starting the punch slide driving (step S60). Once the timer A has counted up the wait time (K−L)/V, the CPU 2002 actuates the sheet processing apparatus control section 205 to drive the punch slide motor to start moving the punching section 90 and the sheet end detecting sensor 93 in the sheet width direction (the arrow D direction in FIG. 2) so that the sheet end detecting sensor 93 can detect the sheet end (step S61).

On the other hand, when the CPU 2002 determines at the step SP56 that the distance K between the sheet detecting sensor 31 and the sheet end detecting sensor 93 is smaller than the minimum punchable length L in the sheet conveying direction, it waits until the sheet detecting sensor 31 detects the leading end of the sheet (step S62). When the sheet detecting sensor 31 detects the leading end of the sheet, the CPU 2002 starts the timer A (step S63).

The CPU 2002 waits until the timer A counts up the wait time (N+K−L)/V before starting the punch slide driving (step S64). Once the timer A has counted up the wait time (N+K−L)/V, the CPU 2002 stops and clears the timer A (step S65). Then, the CPU 2002 actuates the sheet processing apparatus control section 205 to drive the punch slide motor to start moving the punching section 90 and the sheet end detecting sensor 93 in the sheet width direction (the arrow D direction in FIG. 2) so that the sheet end detecting sensor 93 can detect the sheet end (step S66).

When the punching section 90 and the sheet end detecting sensor 93 start moving in the sheet width direction at the step S61 or S66, the sheet end detecting process is started, whereby the sheet end detecting process in FIG. 10, described above, is executed. This process is executed in parallel with the process shown in FIGS. 12, 13, and 14. That is, at the step S31, the CPU 2002 waits until the sheet end detecting sensor 93 detects the sheet end. If the sheet end is detected, then at the step S32, the CPU 2002 stops the punch slide motor to step the movement of the punching section 90 and sheet end detecting sensor 93 to complete the process.

Then, after executing the processing at the step S66, the CPU 2002 waits until the sheet detecting sensor 31 detects the trailing end of the sheet (step S67). When the sheet detecting sensor 31 detects the trailing end of the sheet, the CPU 2002 starts the timer A (step S68). The CPU 2002 then calculates the wait time before starting the punch rotation driving, depending on the predetermined punching position (the position at the distance X from the trailing end of the sheet) (step S69).

Subsequently, the CPU 2002 waits until the timer A counts up the wait time before starting the punch rotation driving (step S70). Then, the CPU 2002 stops and clears the timer A (step S71). Then, the CPU 2002 actuates the sheet processing apparatus control section 205 to drive the punch drive motor to punch the sheet being conveyed (step S72).

The CPU 2002 waits until the punching position detecting sensor 99 detects completion of the punching (step S73). When the completion of the punching is detected, the CPU 2002 actuates the sheet processing apparatus control section 205 to drive the punch slide motor to start moving the punching section 90 and the sheet end detecting sensor 93 toward the punch slide HP (step S74). The CPU 2002 waits until the punch slide HP sensor 94 detects the punch slide HP defining section 95 (step S75). When the punch slide HP defining section 95 is detected, the CPU 2002 stops the movement of the punching section 90 and sheet end detecting sensor 93 to the punch slide HP (step S76).

The CPU 2002 waits until the punching position detecting sensor 99 detects the punch HP (step S77). When the punch HP is detected, the CPU 2002 stops the rotative movement of the punches 91 and dices 92 (step S78) and returns to the processing at the step S54.

Subsequently, the CPU 2002 determines at the step S54 whether or not this job has been completed. If the CPU 2002 determines that the job has been completed, it returns to the processing at the step S51 to prepare for the next job. On the other hand, if the CPU 2002 determines at the step S54 that the job is to be continued, it returns to the processing at the step S52 to continue the image forming operation.

In the image forming system according to the second embodiment, based on the information on the length of the sheet width, the sheet end detecting sensor 93 is first moved to the sheet end detection standby position, and then, to detect the sheet end, the sensor 93 is moved from this position in the timing of the conveyance of the minimum punchable-sized sheet (of the length L), thereby reducing adverse effects of lateral registration and skewing of the sheet. By completing the punch slide movement and performing the punching operation when the sheet end detecting sensor 93 detects the sheet end, deviation of the punching position in the sheet width direction at a right angle with the sheet conveying direction can be minimized to provide a higher-grade sheet processing apparatus for the user.

Although in the present embodiment, the punching process mode is used as an example of the sheet processing mode, the present invention is not limited to this, but is applicable to any operational modes in which the sheets are processed without requiring an alignment operation similar to, for example, the above described punching process mode.

Further, in the above described embodiment, the punching process is carried out while the sheet is being conveyed, but the present invention is not limited to this, but is applicable to a configuration that the sheet is once stopped on the sheet conveyance path, then the punching process is carried out, and then the sheet conveyance is restarted.

That is, even with such a configuration that the sheet is temporarily stopped on the sheet conveyance path for the punching process, the sheet may deviate in a direction perpendicular to the conveying direction or skew unless a sheet alignment operation is carried out before the punching process. If such a phenomenon occurs, the sheet, which has deviated in the direction perpendicular to the conveying direction or has skewed, must be punched as it is, so that the control according to the present embodiment is particularly effective.

It is to be understood that the present invention may also be realized by supplying a system or an apparatus with a storage medium in which the program code of software that realizes the functions of the above described embodiments is recorded, and causing a computer (or CPU, MPU) of the system or apparatus to read out and execute the program code stored in the storage medium.

In this case, the program code itself read out from the storage medium realizes the functions of the above described embodiments, so that the storage medium storing the program code also constitutes the present invention.

FIG. 15 is a diagram showing a memory map for the ROM in the memory 2001 as a storage medium. The ROM stores the punching operation process program module shown in the flow charts in FIGS. 7, 8, and 9, the sheet end detecting process program module shown in the flow chart in FIG. 10, and the punching operation process program module shown in the flow charts in FIGS. 13 and 14.

The storage medium for supplying these program modules is not limited to the ROM, but, for example, a floppy disk, a hard disk, an optical disk, a photoelectromagnetic disk, a CD-ROM, a CD-R, DVD, a magnetic tape, or a non-volatile memory card may be used.

It is to be understood that the functions of the above described embodiments may be accomplished not only by executing a program code read out by a computer, but also by causing an operating system (OS) that operates on the computer to perform a part or the whole of the actual operations according to instructions of the program code.

Furthermore, the program code read out from the storage medium may be written into a memory provided in an expanded board inserted in the computer, or an expanded unit connected to the computer, and a CPU or the like provided in the expanded board or expanded unit may actually perform a part or all of the operations according to the instructions of the program code, so as to accomplish the functions of the above described embodiments.

As described above, according to the present invention, to always detect an end position of a sheet in a direction at a right angle with the sheet conveying direction at a vicinity of an actual sheet processing position irrespective of whether the sheet is large- or small-sized, the timing for starting a sheet end detecting operation performed by a sheet end detecting sensor is controlled depending on information on the sheet length in the conveying direction. For example, the timing for starting the sheet end detecting operation performed by the sheet end detecting sensor is delayed for large-sized sheets, whereas the timing is advanced for small-sized sheets. In this manner, the present invention provides such control that the sheet end is always detected near the actual processing position of the sheet (the trailing end of the sheet) regardless of the sheet length in the conveying direction so that the sheet can be processed at an appropriate position thereof. Thus, adverse effects of lateral registration and skewing of the sheet are reduced, and even if the sheet deviates in a lateral direction or skews, deviation of the sheet processing position in a sheet width direction at a right angle to the sheet conveying direction can be minimized. Therefore, a higher-grade sheet processing apparatus can be provided for users.

What is claimed is:

1. A sheet processing apparatus comprising:

conveying means for conveying a sheet having a side edge extending in a conveying direction of the sheet;

driving means for driving said conveying means;

sheet processing means for processing the sheet, said sheet processing means being movable in a width direction, which is perpendicular to the conveying direction;

first detecting means for detecting the side edge of the sheet, said first detecting means being movable in the width direction together with said sheet processing means;

first moving means for moving said sheet processing means and said first detecting means in the width direction;

second detecting means provided upstream of said sheet processing means in the conveying direction, for detecting a leading edge of the sheet;

third detecting means for detecting a conveying amount by said conveying means in accordance with a signal synchronized with operation of said driving means after said second detecting means detects the leading edge of the sheet;

determining means for determining a length of the sheet in the conveying direction; and control means for controlling said first moving means to move said sheet processing means and said first detecting means in predetermined timing and to stop said sheet processing means and said first detecting means from moving in the width direction in response to said first detecting means detecting the side edge of the sheet, wherein said control means controls the predetermined timing in accordance with the conveying amount detected by said third detecting means and the length determined by said determining means so that said first detecting means detects the side edge of the sheet at a vicinity of a sheet processing position of the sheet at which said sheet processing means processes the sheet.

2. A sheet processing apparatus according to claim 1, wherein said control means determines the predetermined timing based on the length of the sheet in the conveying direction of the sheet.

3. A sheet processing apparatus according to claim 1, wherein said sheet processing means is adapted for processing plural types of sheets of different lengths in the conveying direction of the sheets, and wherein said control means controls the predetermined timing depending on the length of each of the plural types of sheets in the conveying direction of the sheets.

4. A sheet processing apparatus according to claim 3, wherein if the sheet process is carried out on a sheet of a first size or a sheet of a second size having a larger length in the conveying direction of the sheets than said sheet of the first size, said control means delays the predetermined timing for the sheet of the second size with respect to the predetermined timing for the sheet of the first size.

5. A sheet processing apparatus according to claim 3, wherein said control means sets the predetermined timing for each of said plural types of sheets to different values of timing according to the different lengths of said plural types of sheets in the conveying direction of the sheets such that the detection of the side edge of each of the sheets is always carried out at the location close to said sheet processing position.

6. A sheet processing apparatus according to claim 1, wherein said control means causes said sheet processing means to process the sheet without stopping the conveyance of the sheet by said conveying means.

7. A sheet processing apparatus according to claim 1, wherein said sheet processing means includes punching process means for executing a punching process on the sheet.

8. A sheet processing apparatus according to claim 1, wherein said sheet processing means processes the sheet without executing a sheet aligning process on the sheet.

9. A sheet processing apparatus according to claim 1, wherein said sheet processing apparatus is adapted for connecting to an image forming apparatus for forming images on a sheet., and wherein said sheet processing means processes the sheet supplied from said image forming apparatus.

10. A sheet processing apparatus according to claim 1, wherein said sheet processing means processes the sheet at a vicinity of a trailing end of the sheet, and wherein said control means controls the predetermined timing so that said first detecting means detects the side edge of the sheet at a vicinity of a location at which said sheet processing means processes the sheet.

11. A sheet processing apparatus according to claim 1, wherein said sheet processing means punches holes through the sheet.

12. A sheet processing apparatus according to claim 11, wherein the holes are aligned along a direction that is perpendicular to the conveying direction of the sheet.

13. A sheet processing apparatus according to claim 1, wherein said first detecting means comprises a light emitting part and a light receiving part to detect the side edge of the sheet.

14. A sheet processing apparatus according to claim 1, further including second moving means for moving said first detecting means in the width direction before conveying the sheet.

15. A sheet processing apparatus comprising:

a conveyor that conveys a sheet having a side edge extending in a conveying direction of the sheet;

a motor that drives said conveyor;

a sheet processor that processes the sheet, said sheet processor being movable in a width direction, which is perpendicular to the conveying direction;

a first detector that detects the side edge of the sheet, said first detector being movable in the width direction together with said sheet processor;

a first moving device that moves said sheet processor and said first detector in the width direction;

a second detector that detects a leading edge of the sheet, said second detector being provided upstream of said sheet processor in the conveying direction;

a third detector that detects a conveying amount by said conveyor in accordance with a signal synchronized with operation of said motor after said second detector detects the leading edge of the sheet;

a determining device that determines a length of the sheet in the conveying direction; and a controller that controls said first moving device to move said sheet processor and said first detector in predetermined timing and to stop said sheet processor and said first detector from moving in the width direction in response to said first detector detecting the side edge of the sheet, wherein said controller controls the predetermined timing in accordance with the conveying amount detected by said third detector and the length determined by said determining device so that said first detector detects the side edge of the sheet at a vicinity of a sheet processing position of the sheet at which said sheet processor processes the sheet.

16. A sheet processing apparatus according to claim 15, wherein said sheet processor punches holes through the sheet.

17. A sheet processing apparatus according to claim 16, wherein the holes are aligned along a direction that is perpendicular to the conveying direction of the sheet.

18. A sheet processing apparatus according to claim 15, wherein said first detector comprises a light emitting part and a light receiving part to detect the side edge of the sheet.

19. A sheet processing apparatus according to claim 15, further including a second moving device that moves said first detector in the width direction before conveying the sheet.

20. A sheet processing apparatus comprising:

conveying means for conveying a sheet having a side edge extending in a conveying direction of the sheet;

driving means for driving said conveying means;

sheet processing means for processing the sheet, said sheet processing means being movable in, a width direction, which is perpendicular to the conveying direction;

first detecting means for detecting the side edge of the sheet, said first detecting means being movable in the width direction together with said sheet processing means;

moving means for moving said sheet processing means and said first detecting means in the width direction;

second detecting means provided upstream of said sheet processing means in the conveying direction, for detecting a trailing edge of the sheet;

third detecting means for detecting a conveying amount by said conveying means in accordance with a signal synchronized with operation of said driving means after said second detecting means detects the trailing edge of the sheet;

determining means for determining a length of the sheet in the conveying direction; and control means for controlling said moving means to move said sheet processing means and said first detecting means in predetermined timing and to stop said sheet processing means and said first detecting means from moving in the width direction in response to said first detecting means detecting the side edge of the sheet, wherein said control means controls the predetermined timing in accordance with the conveying amount detected, by said third detecting means and the length determined by said determining means so that said first detecting means detects the side edge of the sheet at a vicinity of a sheet processing position of the sheet at which said sheet processing means processes the sheet.

21. A sheet processing apparatus comprising:

a conveyor that conveys a sheet having a side edge extending in a conveying direction of the sheet;

a motor that drives said conveyor;

a sheet processor that processes the sheet, said sheet processor being movable in a width direction, which is perpendicular to the conveying direction;

a first detector that detects the side edge of the sheet, said first detector being movable in the width direction together with said sheet processor;

a moving device that moves said sheet processor and said first detector in the width direction;

a second detector that detects a trailing edge of the sheet, said second detector being provided upstream of said sheet processor in the conveying direction;

a third detector that detects a conveying amount by said conveyor in accordance with a signal synchronized operation of said motor after said second detector detects the trailing edge of the sheet;

a determining device that determines a length of the sheet in the conveying direction; and a controller that controls said moving device to move said sheet processor and said first detector in predetermined timing and to stop said sheet processor and said first detector from moving in the width direction in response to said first detector detecting the side edge of the sheet, wherein said controller controls the predetermined timing in accordance with the conveying amount detected by said third detector and the length determined by said determining device so that said first detector detects the side edge of the sheet at a vicinity of a sheet processing position of the sheet at which said sheet processor processes the sheet.

* * * * *